US007239833B2

(12) United States Patent
Tomita et al.

(10) Patent No.: US 7,239,833 B2
(45) Date of Patent: Jul. 3, 2007

(54) IMAGE FORMING DEVICE AND COLOR MISREGISTRATION CORRECTION METHOD FOR IMAGE FORMING DEVICE

(75) Inventors: Norio Tomita, Yamatokoriyama (JP); Masanobu Yamamoto, Nara (JP); Kyosuke Taka, Nara (JP); Yoshikazu Harada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 124 days.

(21) Appl. No.: 10/924,766

(22) Filed: Aug. 25, 2004

(65) Prior Publication Data

US 2005/0047834 A1 Mar. 3, 2005

(30) Foreign Application Priority Data

Aug. 26, 2003 (JP) ..... 2003-208888

(51) Int. Cl.
*G03G 15/01* (2006.01)

(52) U.S. Cl. ..... 399/299; 399/301; 399/302

(58) Field of Classification Search ..... 399/301, 399/49, 116, 179, 299, 302; 347/116
See application file for complete search history.

(56) References Cited

U.S. PATENT DOCUMENTS 5,881,346 A * 3/1999 Mori et al. ..... 399/301
5,909,235 A * 6/1999 Folkins ..... 347/240
6,148,168 A * 11/2000 Hirai et al. ..... 399/301
6,198,549 B1 * 3/2001 Decker et al. ..... 358/504
6,360,070 B1 3/2002 Taka et al.
6,674,998 B2 * 1/2004 Prentice ..... 455/114.2
6,885,841 B2 * 4/2005 Harada et al. ..... 399/301
6,915,096 B2 * 7/2005 Taka et al. ..... 399/301
6,957,031 B2 * 10/2005 Tomita et al. ..... 399/301
2003/0210412 A1 * 11/2003 Ishibashi ..... 358/1.9
2005/0041990 A1 * 2/2005 Sugiyama ..... 399/49

FOREIGN PATENT DOCUMENTS

JP 2000-221749 A 8/2000

* cited by examiner

*Primary Examiner*—David M. Gray
*Assistant Examiner*—Geoffrey T Evans
(74) *Attorney, Agent, or Firm*—Birch, Stewart, Kolasch & Birch, LLP

(57) ABSTRACT

An image forming device and a color misregistration correction method allow for stable formation of excellent images with little color misregistration. A reference patch image is formed on a reference photosensitive drum 3, and transferred to a transfer belt 7. A correction patch image is formed on a correction-target photosensitive drum 3, and transferred onto the reference patch image by superimposition. A registration detecting sensor 21 detects a density average value of the reference patch image and the correction patch image. Based on the density average value, a correction value for controlling the correction-target photosensitive drum 3 is calculated, and rotational phase control is performed in accordance with the correction value.

26 Claims, 13 Drawing Sheets

IMAGE FORMING DEVICE AND COLOR MISREGISTRATION CORRECTION METHOD FOR IMAGE FORMING DEVICE

BACKGROUND OF THE INVENTION

This nonprovisional application claims priority under 35 U.S.C. § 119(a) on patent application No. 2003/208888 filed in Japan on Aug. 26, 2003, the entire contents of which are hereby incorporated by reference.

1. Field of the Invention

The present invention relates to an electrophotographic image forming device and a color misregistration correction method for the image forming device. More specifically, the present invention relates to (i) an image forming device that automatically adjusts phases of unevenness in rotation of image supporting bodies (the unevenness in rotation of the image forming bodies results in a color misregistration of a multicolor image when the multicolor image is formed by superimposing color component images formed on the image supporting bodies or on a transfer supporting body), and relates to (ii) a color correction method for the image forming device, the method being for automatically correcting the color misregistration of the multicolor image.

2. Description of the Related Art

Conventionally, image forming devices (e.g. digital color copying devices) form multicolor images by resolving inputted image data into color components, performing image processing on the color components, and superimposing images of the color components. With such image forming devices, the resultant multicolor images suffer from color misregistration if the images of the color components are not superimposed accurately. This often deteriorates image quality.

In conventionally known tandem-type image forming devices, an image forming section is provided for each color component, so as to form multicolor images more speedily. In the tandem-type image forming devices, image forming sections respectively form corresponding color component images. The corresponding color component images are then sequentially superimposed. In this way, multicolor images are formed. In such image forming devices, an image supporting body (photosensitive drum) in one image forming section differs from an image supporting body (photosensitive drum) in another image supporting body, in terms of rotational behavior. Therefore, the color component images are often transferred to different positions.

In the tandem-type image forming devices, a writing device is provided for each color, and each writing device forms an electrostatic latent image on an image supporting body provided for that color. By developing the electrostatic latent images, the color component images are formed. The color component images are then superimposed on a recording medium. Therefore, if the rotational axis (core) of the image supporting body is shifted, unevenness in rotation (a phenomenon that the surface velocity of the image supporting body is not constant) is caused. In such a case, color misregistration is likely to occur due to the unevenness in rotation. Thus, the color misregistration of multicolor images is a significant problem of the tandem-type image forming devices.

In view of this problem, some image forming devices perform adjustment for synchronizing rotational phases of image supporting bodies, so as to reduce the unevenness in rotation, and form excellent multicolor images with little color misregistration. The adjustment for synchronizing rotational phases is performed as follows. In each image forming station, an image for color misregistration correction is formed, and then outputted. An image formed by the outputs is checked visually. Based on the visual check, a correction value (value used for synchronizing the rotational phases of the image supporting bodies) that minimizes the color misregistration is calculated. Then, the correction value is inputted to an operating section. The adjustment is performed on the following occasions, for example: (i) before shipping the image forming devices after the image forming devices are manufactured, (ii) after parts of the image forming devices are manufactured and/or maintenance (e.g. replacement) of the parts of the image forming devices is performed, and/or (iii) before forming a multicolor image in the case where the image forming devices have not been used for a long time.

To prevent the color misregistration of multicolor images, some image forming devices detect the density of the pattern image after forming a pattern image, thereby controlling the rotation of the image supporting bodies. Other image forming devices control the timing of recording start signals. These image forming devices are disclosed in Patent Publications 1 to 3, for example.

In the image forming device disclosed in Patent Publication 1, an image pattern is formed by positioning a plurality of predetermined lines on each image supporting body at identical time intervals. Then, by using an optical sensor unit, the toner density of the image pattern is detected. Based on the result of detection, the unevenness in rotation in each of the plurality of image supporting bodies is detected. Based on the detected unevenness in rotation, the rotation of each of the plurality of image supporting bodies is controlled so as to synchronize the rotational phases of the plurality of image supporting bodies having the unevenness in rotation. In this way, the color misregistration is prevented.

In the image forming device disclosed in Patent Publication 2, the phase of each photosensitive drum is shifted in advance, so as to make it possible to shift the phase of driving unevenness. By shifting the phase, even if the distance between adjoining transfer positions corresponding to the image forming stations is set shorter than the circumference of the photosensitive drum, the variation of each photosensitive drum due to driving unevenness with respect to the printing medium passing through the transfer position can be congruent with the others. As a result, the color misregistration caused by the influence of the driving unevenness is prevented.

The image forming device disclosed in Patent Publication 3 performs color misregistration correction as follows. First, the density of an overlapping part of two pattern images (a pattern image formed on a photosensitive drum of the image forming section of a reference color component and transferred onto a transfer conveyer belt, and a pattern image formed and transferred by the image forming section of a color component to be adjusted) is measured. Then, an input of a recording start signal to a laser beam scanner for the color component to be adjusted is delayed or put forward, so that the measured value falls within an acceptable range around a density value at which the pattern images are superimposed at ideal accuracy.

(Patent Publication 1)

Japanese Publication for Unexamined Patent Application, Tokukai 2000-221749 (publication date: Aug. 11, 2000)

(Patent Publication 2)

Japanese Publication for Unexamined Patent Application, Tokukai 2000-137424 (publication date: May 16, 2000); U.S. Pat. No. 6,360,070

(Patent Publication 3)

Japanese Publication for Unexamined Patent Application, Tokukai 2000-81744 (publication date: Mar. 21, 2000); U.S. Pat. No. 6,148,168

However, the image forming device of Patent Publication 1 detects the unevenness in rotation of the image supporting body with respect to each image forming unit, and the rotational phase of each image supporting body is controlled in accordance with (i) a reference pattern provided for each color and (ii) detected information on the unevenness in rotation. Therefore, the phase of unevenness in rotation is obtained with respect to each image supporting body. As a result, there is a problem that a computing unit or the like device is required.

Moreover, even if there is unevenness in rotation, density does not vary significantly within a pattern image formed by a single image supporting body for the purpose of detecting the unevenness in rotation. Therefore, the detection is difficult in the case where the density variation within the pattern image formed by a single image supporting body is detected with respect to each image forming unit. In addition, because the pattern image needs to be formed in each image forming unit, there is a problem that it is necessary to form pattern images respectively at four places corresponding to four colors (C, M, Y, and K).

In the image forming device of Patent Publication 2, the phases of driving unevenness in the photosensitive drums are shifted in advance by about 60 degrees each. Therefore, the driving unevenness of the photosensitive drums is not detected by detecting the density variation within the pattern or the like formed with respect to each color component. Therefore, there is a problem that it is difficult to control the rotational phases at high accuracy.

Moreover, in the image forming device of Patent Publication 3, a pattern formed on an image supporting body that is a target of correction (correction-target image supporting body) is superimposed on an image formed on an image supporting body that is to be a reference point (reference image supporting body), and this is performed while changing the formation timing of the pattern on the correction-target supporting body. That is to say, phase differences are not taken into consideration. Therefore, if there are phase differences among rotational movements of the image supporting bodies, there are problems that desired color misregistration correction cannot be performed, and/or that a long adjustment time is required due to errors occurring during adjustment.

SUMMARY OF THE INVENTION

The present invention was made to solve the foregoing problems. An object of the present invention is therefore to provide an image forming device and a color misregistration correction method, which allow for stably forming an excellent image with little color misregistration, by measuring the density of a pattern formed by superimposing (i) a pattern formed on a reference image supporting body and (ii) a pattern formed on another image supporting body, and controlling rotational phases of the image supporting bodies in accordance with the result of measurement.

To solve the foregoing problems, an image forming device of the present invention includes: a plurality of image supporting bodies on which images of different color components are formed in accordance with image data; a transfer supporting body that moves in a sub-scanning direction so that the images of different color components are sequentially superimposed on the transfer supporting body; a density detecting device that detects a density average value with respect to each of a plurality of group images formed at different positions by superimposing the images of different color components; a correction value calculating device that calculates, in accordance with the density average value, a correction value to be used for synchronizing rotational phases of the plurality of image supporting bodies; and a rotational phase control device that controls the rotational phases of the plurality of image supporting bodies in accordance with the correction value.

Likewise, to solve the foregoing problems, a color misregistration correction method of the present invention includes: an image forming step, in which images of different color components are formed on a plurality of image supporting bodies in accordance with image data; an image superimposing step, in which the images of different color components are sequentially superimposed on a transfer supporting body, which is moving in a sub-scanning direction; a density detecting step, in which a density average value is detected by using a density detecting device with respect to each of a plurality of group images formed at different positions by superimposing the images of different color components; a correction value calculating step, in which a correction value to be used for synchronizing rotational phases of the plurality of image supporting bodies is calculated in accordance with the density average value; and a rotational phase control step, in which the rotational phases of the plurality of image supporting bodies are controlled in accordance with the correction value.

According to this arrangement, the density average value of each of the plurality of group images formed by superimposing the images of different color components is detected, and the correction value for synchronizing the rotational phases of the image supporting bodies is calculated in accordance with the density average value. By controlling the rotational phases of the image supporting bodies in accordance with the correction value, the rotational phases of the image supporting bodies can be synchronized. Therefore, it is possible to stably form an excellent image with little color misregistration.

Moreover, because the correction value is calculated by the image forming device itself, the correction value can be calculated more accurately, and the number of steps can be reduced, as compared with a case where the outputted image is visually checked by a human. Therefore, an accurate correction value can be calculated immediately.

For a fuller understanding of the nature and advantages of the invention, reference should be made to the ensuing detailed description taken in conjunction with the accompanying drawings.

BRIEF DESCRIPTION OF THE DRAWINGS

FIG. 7(*b*) is a perspective view illustrating a schematic arrangement of a registration detecting sensor of one embodiment of the present invention.

DESCRIPTION OF THE INVENTION

With reference to FIGS. 1 to 13, the following describes one embodiment of the present invention.

Figure 1:
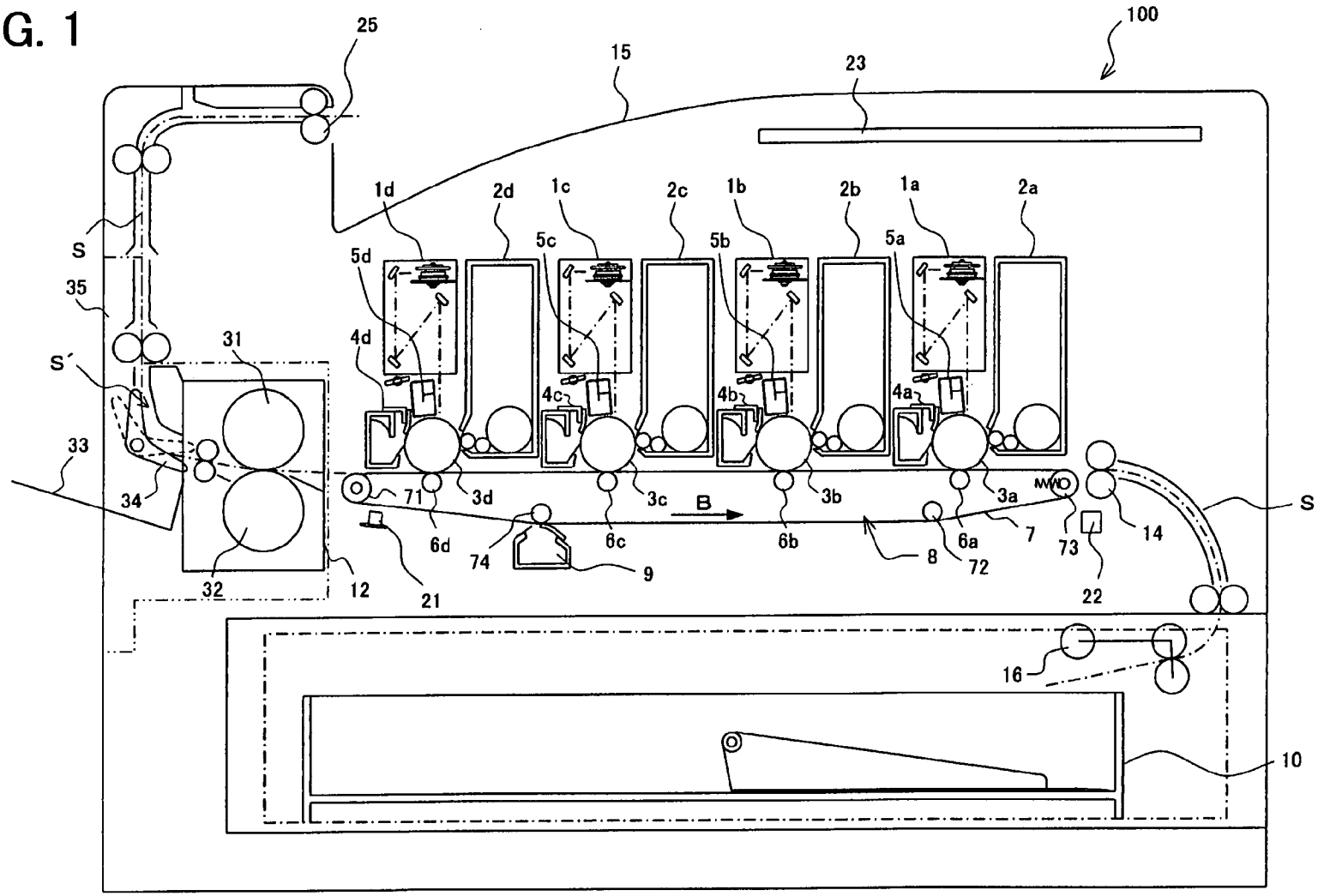
FIG. 1 is a cross-sectional view illustrating a schematic arrangement of an image forming device of one embodiment of the present invention.

FIG. 1 is a cross-sectional view illustrating a schematic arrangement of an image forming device of the present embodiment.

An image forming device 100 of the present embodiment forms a multicolor image or a single-color image on a predetermined sheet (recording sheet), in accordance with image data inputted from an external entity. As shown in FIG. 1, the image forming device 100 includes a feed tray 10, ejection trays 15 and 33, and a fixing unit 12, in addition to members for controlling rotational phases of image supporting bodies so as to correct color misregistration of a multicolor image. The members for controlling the rotational phases of the image supporting bodies so as to correct the color misregistration of the multicolor image are described later.

The feed tray 10 is a tray for storing recording sheets on which images are to be recorded. The ejection trays 15 and 33 are trays on which the recording sheets are placed after images are recorded. The ejection tray 15 is provided on top of the image forming device 100. After printing, the recording sheets are placed on the ejection tray 15 with the faces down. The ejection tray 33 is provided on a side of the image forming device 100. After printing, the recording sheets are placed on the ejection tray 33 with the faces up.

The fixing unit 12 includes a heat roller 31 and a pressurizing roller 32. The heat roller 31 is set to a predetermined temperature in accordance with a temperature detected by a thermometer (not shown). The heat roller 31 and the pressurizing roller 32 rotate while sandwiching a recording sheet onto which a toner image has been transferred. Due to the heat of the heat roller 31, the toner image is fixed by thermo compression onto the recording sheet.

Described next are the members of the image forming device 100 for controlling the rotational phases of the image supporting bodies so as to correct the color misregistration of the multicolor image.

As the members for controlling the rotational phases of the image supporting bodies, the image forming device 100 includes an image forming station, a transfer conveyer belt unit 8, a registration detecting sensor (density detecting device) 21, a temperature and moisture sensor 22, and a control section (a correction value calculating device, a rotational phase control device, a color superimposition control device, and an adjustment device) 23.

The image forming station forms a multicolor image by using the following colors: black (K), cyan (C), magenta (M), and yellow (Y). In order to form four kinds of latent images corresponding to the foregoing colors, the image forming station includes exposure units 1*a*, 1*b*, 1*c*, and 1*d*, developing devices 2*a*, 2*b*, 2*c*, and 2*d*, photosensitive drums 3*a*, 3*b*, 3*c*, and 3*d*, cleaner units 4*a*, 4*b*, 4*c*, and 4*d*, and chargers 5*a*, 5*b*, 5*c*, and 5*d*. The reference marks a, b, c, and d correspond to black (K), cyan (C), magenta (M), and yellow (Y), respectively.

In the following description, the four members respectively provided for the four colors are collectively referred to as exposure unit 1, developing device 2, photosensitive drum 3, cleaner unit 4, and charger 5, except in cases where a member for a specific color is referred to.

The exposure unit 1 is a writing head made of ELs, LEDs, or the like light-emitting elements arranged in arrays. Alternatively, the exposure unit 1 is a laser scanning unit (LSU) including a laser radiation section and a reflecting mirror. As shown in FIG. 1, the exposure unit 1 of the present embodiment is the LSU. The exposure unit 1 exposes the photosensitive drum 3 in accordance with the inputted image data, thereby forming an electrostatic latent image in accordance with the image data, on the photosensitive drum 3.

The developing device 2 visualizes the electrostatic latent image formed on the photosensitive drum 3, by using toner of the foregoing colors.

The photosensitive drum (image supporting body) 3 is positioned at the center of the image forming device 100. On the surface of the photosensitive drum 3, the electrostatic latent image or a toner image is formed in accordance with the inputted image data.

The cleaner unit 4 removes and collects remaining toner on the photosensitive drum 3 after the electrostatic latent image formed on the surface of the photosensitive drum 3 is developed and the visualized image is transferred onto the recording sheet or the like.

The charger 5 evenly charges the surface of the photosensitive drum 3 until a predetermined potential is attained. The charger 5 is a roller-type or brush-type charger, which contacts the photosensitive drum 3. Alternatively, the charger 5 may be a discharge-type or the like charger, which does not contact the photosensitive drum 3. In the present embodiment, the discharge-type charger is used.

The transfer conveyer belt unit 8 is provided below the photosensitive drum 3. The transfer conveyer belt unit 8 includes a transfer belt (transfer supporting body) 7, a transfer belt driving roller 71, a transfer belt tension roller 73, transfer belt driven rollers 72 and 74, transfer rollers 6*a*, 6*b*, 6*c*, and 6*d*, and a transfer belt cleaning unit 9. In the following description, the four transfer rollers 6*a*, 6*b*, 6*c*, and 6*d*, which are respectively provided for the four colors, are collectively referred to as transfer roller 6.

Members such as the transfer belt driving roller 71, the transfer belt tension roller 73, the transfer roller 6, and the transfer belt driven rollers 72 and 74 support the transfer belt 7 in a tensioned state, and rotationally drive the transfer belt 7 in the direction of arrow B.

The transfer roller 6 is rotatably supported by a housing of the transfer conveyer belt unit 8. The transfer roller 6 has, as a main part, a metal shaft of 8 mm to 10 mm in diameter. The surface of the transfer roller 6 is covered with EPDM, urethane foam, or the like conductive elastic material. By using the conductive elastic material, it is possible to evenly apply, to the recording sheet, a high voltage having a polarity reverse to the polarity of the toner. As a result, a toner image formed on the photosensitive drum 3 is transferred to the transfer belt 7 or to a recording sheet that is conveyed while adsorbed on the transfer belt 7.

The transfer belt 7 is made of polycarbonate, polyimide, polyamide, polyvinylidene fluoride, polytetrafluoroethylene polymer, ethylene tetrafluoroethylene polymer, or the like. The transfer belt 7 is provided so as to contact the photosensitive drum 3. By sequentially transferring a toner image of each color (the toner image is formed on the photosensitive drum 3) to the transfer belt 7 or to the recording sheet that is conveyed while adsorbed on the transfer belt 7, a multicolor toner image is formed. The transfer belt 7 is about 100 μm to 150 μm in thickness. The transfer belt 7 is made of a film, and therefore has no end. The transfer belt 7 is non-transparent and black.

The transfer belt cleaning unit 9 removes and collects toner (toner for rotational phase control and toner for process control) that has adhered to the transfer belt 7 by being directly transferred to the transfer belt 7. The transfer belt cleaning unit 9 also removes and collects toner that has adhered to the transfer belt 7 due to contact between the photosensitive drum 3 and the transfer belt 7.

The registration detecting sensor 21 detects the density of a patch image formed by the image forming station on the transfer belt 7. For this purpose, the registration detecting sensor 21 is provided to such a position of the transfer belt 7 that is downstream of the image forming station and upstream of the transfer belt cleaning unit 9.

The temperature and moisture sensor 22 detects the temperature and moisture in the image forming device 100. The temperature and moisture sensor 22 is provided in the vicinity of a process section where no rapid temperature change or moisture change occurs.

In accordance with the density of patch image detected by the registration detecting section 21 and/or in accordance with the temperature and moisture detected by the temperature and moisture sensor 22, the control section 23 performs process control for maintaining always excellent image quality, and controls the rotational phases of the photosensitive drums 3. The control section 23 also controls a series of operation of the members for image formation.

The transfer belt 7 is rotationally driven by the transfer belt driving roller 71, the transfer belt tension roller 73, the transfer belt driven rollers 72 and 74, and the transfer roller 6. Therefore, the toner image of each color is sequentially transferred and superimposed onto the transfer belt 7 or onto the recording sheet that is conveyed while adsorbed on the transfer belt 7. As a result, a multicolor toner image is formed. If the multicolor toner image is formed on the transfer belt 7, the multicolor toner image is further transferred to a recording sheet.

Figure 2:
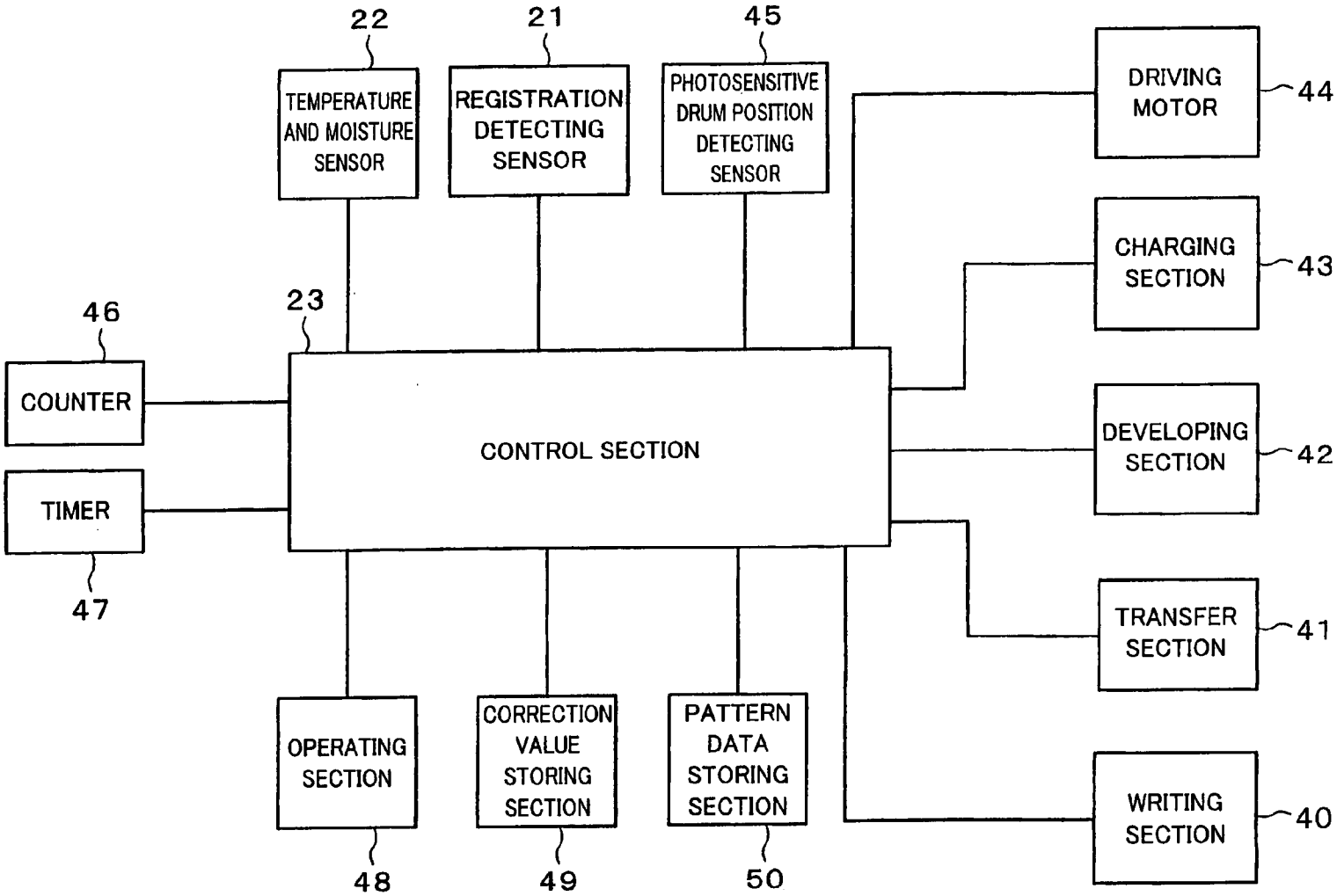
FIG. 2 is a block diagram illustrating a schematic arrangement of sections associated with a control section of the image forming device.

FIG. 2 is a block diagram illustrating a schematic arrangement of the sections associated with the control section 23, among the sections for controlling the rotational phases of the photosensitive drums 3 so as to adjust the color misregistration of the multicolor image.

The sections for controlling the rotational phases includes the control section 23 and members connected thereto (a writing section 40, a transfer section 41, a developing section 42, a charging section 43, a driving motor 44, a photosensitive drum position detecting sensor 45, the registration detecting sensor 21, the temperature and moisture sensor 22, a counter 46, a timer 47, an operating section 48, a correction value storing section 49, and a pattern data storing section 50.

The control section 23 is a section for processing data and transmits a control signal to each of the foregoing members. The writing section 40 principally refers to the exposure unit 1. The writing section 40 is a section for forming an electrostatic latent image on the photosensitive drum 3. The transfer section 41 principally refers to the transfer roller 6. The transfer section 41 is a section for transferring a toner image to the transfer belt 7 or a recording sheet. The developing section 42 principally refers to the developing device 2. The developing section 42 is a section for turning the electrostatic latent image on the photosensitive drum 3 into a toner image. The charging section 43 principally refers to the charger 5. The charging section 43 is a section for charging the photosensitive drum 3. The driving motor 44 includes a driving source and a transmitting mechanism for rotating the photosensitive drum 3. The photosensitive drum position detecting sensor 45 detects the timing at which a reference mark on the photosensitive drum 3 passes through the photosensitive drum position detecting sensor 45, thereby detecting at which position (angle) the photosensitive drum 3 is located with respect to the photosensitive drum position detecting sensor 45. The counter 46 is a section for counting the number of rotation of the photosensitive drum 3 and/or the number of times image formation is executed. The timer 47 is a section for counting the time between the points at which the rotational phase of the photosensitive drum 3 is controlled. The timer 47 is started when the rotational phase control of the photosensitive drum 3 is executed after the image forming device 100 is turned ON. Thereafter, the timer 47 is reset every time the rotational phase control of the photosensitive drum 3 is executed. The operating section 48 is a section for setting what kind of control to execute. The correction value storing section 49 is a section for storing the correction value (value used for controlling the rotational phases of the photosensitive drums 3), which is calculated in accordance with values detected by the registration detecting sensor 21 and the temperature and moisture sensor 22. The pattern data storing section 50 is a section for storing patterns used for forming a reference patch image and a correction patch image (which are described later) on the transfer belt 7.

In order to control the rotational phases of the photosensitive drums 3 in the image forming device 100 of the present embodiment, the toner image of each color formed in the image forming station is transferred to the transfer belt 7. At this time, the toner image of one of the color components is transferred first, as a reference toner image (reference image), to the transfer belt 7. Then, the toner image of another color component (correction image; target of rotational phase control) is transferred onto the reference image. In this way, a group image is formed. However, this order is revered if the photosensitive drum for the reference toner image is positioned at the downstream, in a sub-scanning direction, of the photosensitive drum that is the target of the rotational phase control (control-target photosensitive drum). That is, the reference toner image (reference image) is formed on the toner image of another color component (correction image; target of rotational phase control). In the following description, the reference image is referred to as reference patch image, and the correction image is referred to as correction patch image.

The series of image forming operation in the image forming device 100 are described below.

When image data is inputted to the image forming device 100, the exposure unit 1 exposes the surface of the photosensitive drum 3 in accordance with the inputted image data. In this way, an electrostatic latent image is formed on the photosensitive drum 3.

Then, the developer 2 develops the electrostatic latent image into a toner image. Meanwhile, recording sheets stored on the feed tray 10 are separated one by one by a pickup roller 16. Then, each recording sheet is conveyed to a sheet conveying path S, and temporarily held between registration rollers 14. The registration rollers 14 convey the recording sheet to the transfer belt 7 in accordance with the rotation of the photosensitive drum 3. In so doing, the registration rollers 14 control the timing for conveyance in accordance with a detection signal from a pre-registration detecting switch (not shown). In this way, the timing for conveyance is controlled so that the front end of the toner image on the photosensitive drum 3 corresponds to the front end of an image formation region of the recording sheet. The recording sheet is conveyed while adsorbed to the transfer belt 7.

The transfer of the toner image from the photosensitive drum 3 to the recording sheet is performed through the transfer belt 7 by the transfer roller 6, which is provided face-to-face with the photosensitive drum 3. The transfer roller 6 is subjected to a high voltage having a polarity reverse to the polarity of the toner. Due to the high voltage, the toner image is formed on the recording sheet. On the recording sheet conveyed by the transfer belt 7, four kinds of toner images of the respective colors are superimposed sequentially.

After that, the recording sheet is conveyed to the fixing unit 12, and the toner image is fixed on the recording sheet by thermo compression. Then, owing to operation for switching conveying paths, the switching operation performed by a conveyance switching guide 34, the recording sheet is conveyed to the ejection tray 33 or, through a sheet conveying path S', to the ejection tray 15.

After the toner images are transferred to the recording sheet, the cleaner unit 4 collects and removes the remaining toner on the photosensitive drum 3. The transfer belt cleaning unit 9 collects and removes the toner adhered to the transfer belt 7. This is the end of the series of image forming operation.

Figure 3:
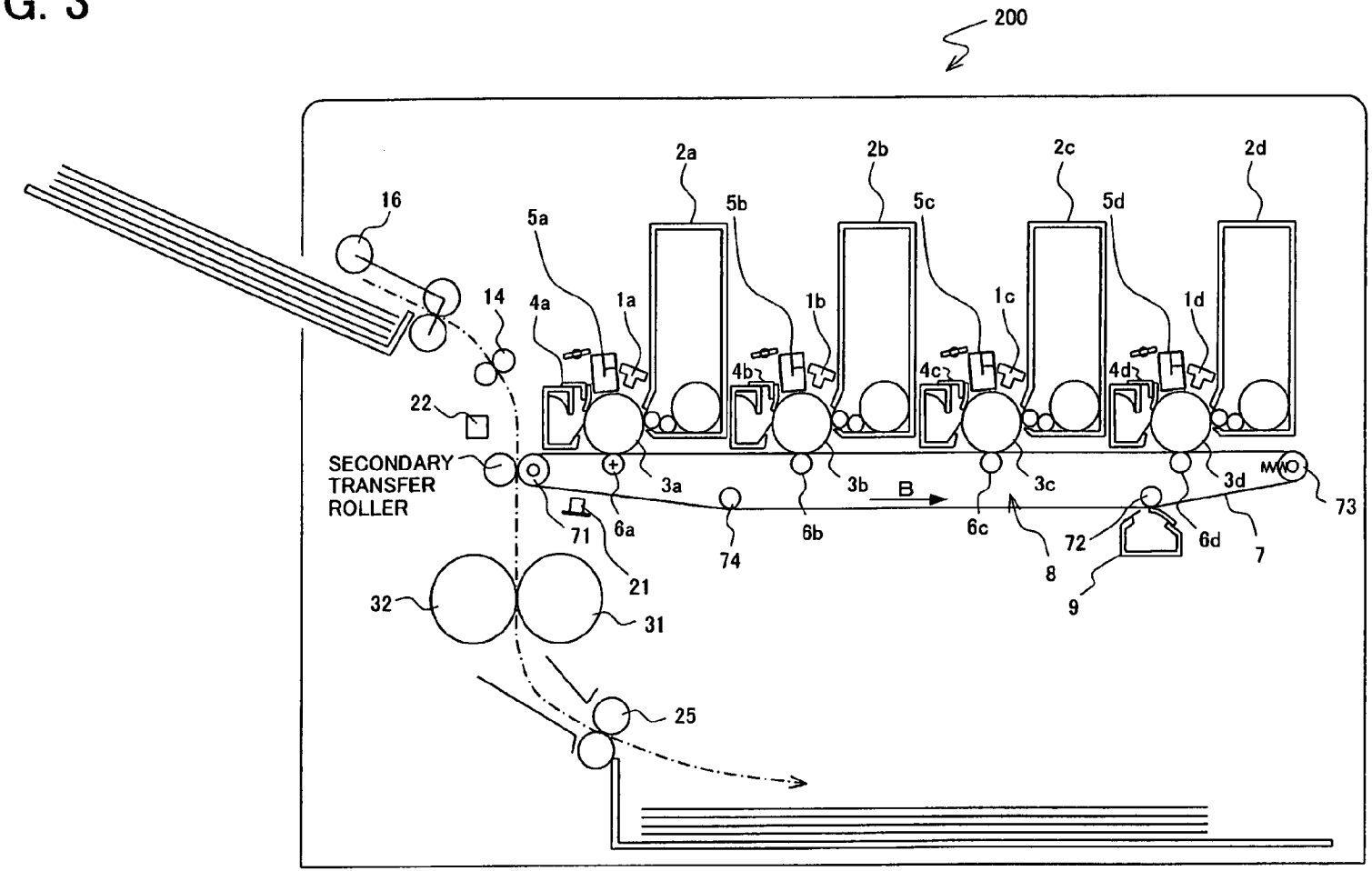
FIG. 3 is a cross-sectional view illustrating a schematic arrangement of an image forming device of another embodiment of the present invention.

The image forming device 100 of the present embodiment is a direct-transfer-type image forming device, in which the recording sheet is supported on the transfer belt 7, and the toner images respectively formed on photosensitive drums are superimposed on the recording sheet. However, the image forming device may be an intermediary-transfer-type image forming device 200, as shown in FIG. 3. In the image forming device 200, the toner images respectively formed on the photosensitive drums 3 are transferred by superimposition onto the transfer belt 7, and then the toner images are transferred onto the recording sheet at once. In this way, a multicolor image is formed.

Figure 4:
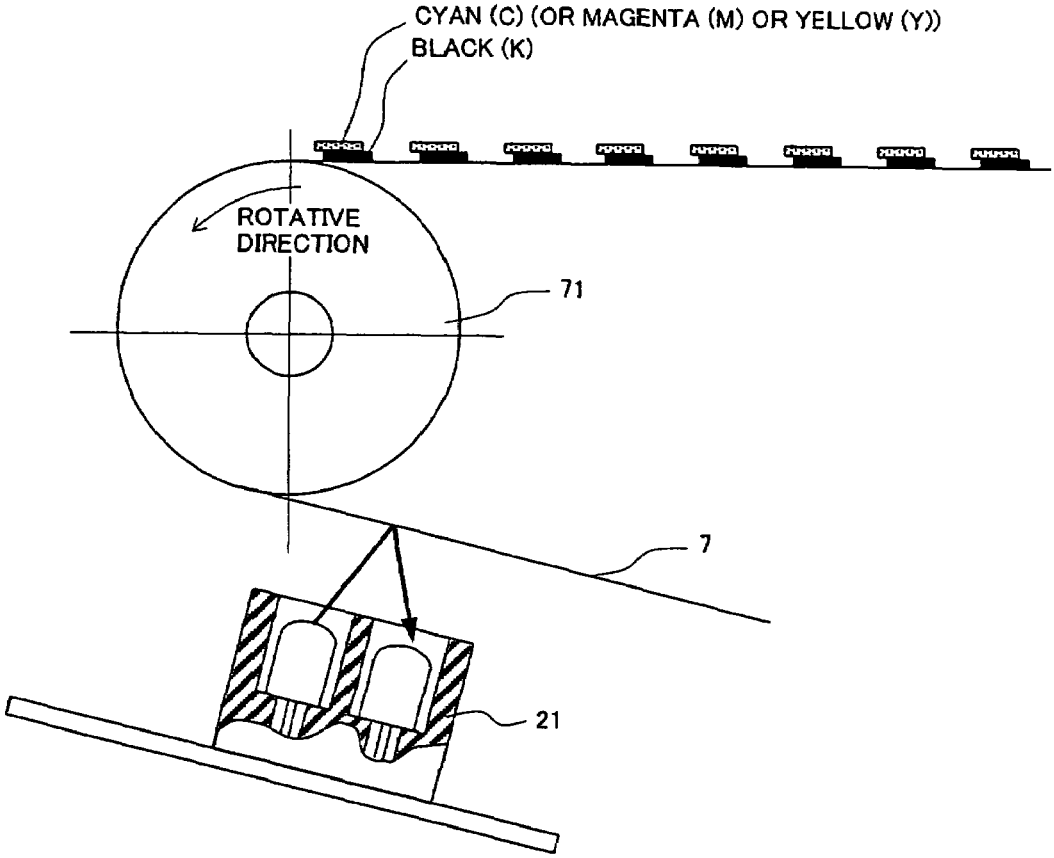
FIG. 4 is a cross-sectional view illustrating a toner image formed on a transfer belt of the image forming device of one embodiment of the present invention.

FIG. 4 is an explanatory diagram illustrating a toner image formed on the transfer belt 7 in the case where a toner image of black (K) is set as a reference patch image, and a correction patch image (e.g. toner image of cyan (C)) is transferred onto the reference patch image.

As described above, the transfer belt 7 is rotationally driven by the transfer belt driving roller 71 and the like provided to the transfer conveyer belt unit 8. Therefore, as shown in FIG. 4, when the reference patch image and the correction patch image that have been formed on the transfer belt 7 arrive at the position of the registration detecting sensor 21, the registration detecting sensor 21 detects an average value (hereinafter "density average value") of (i) the density of the reference patch image on the transfer belt 7 and (ii) the density of the correction patch image on the transfer belt 7.

More specifically, the registration detecting sensor 21 radiates light onto the transfer belt 7, and detects the light reflected on the transfer belt 7. In this way, the registration detecting sensor 21 detects the density average value of the reference patch image and the correction patch image. Based on the result of detection, the registration detecting sensor 21 corrects the exposure timing of the exposure unit 1, thereby correcting the timing of writing images onto the photosensitive drum 3. Thus, the control section 23 controls the sections for image formation, so that image quality is always kept excellent in terms of density (this control is called "process control").

Specifically, the process control is controlling, for example, a grid bias voltage of the charger 5, a development bias voltage of the developing device 2, a transfer bias voltage of the transfer belt unit 8, an output of the exposure unit 1, and an intermediate tone table in an image processing section, in accordance with the density average value and/or environmental conditions (temperature and/or moisture). The process control makes it possible to perform excellent image formation.

As shown in FIG. 4, the registration detecting sensor 21 is provided in such a manner that the light-emitting position and the light-detecting position are face-to-face with the transfer belt 7. However, if a mirror or the like is used, the registration detecting sensor 21 may be provided in such a manner that the light-emitting position and the light-detecting position are not face-to-face with the transfer belt 7.

The registration detecting sensor 21 is used not only to detect the density average value for the process control, but also to detect the density average value for the rotational phase control (described later) of the present invention for the photosensitive drums 3.

In the present embodiment, the processing speed for image formation is set to 100 mm/sec. The detection by the registration detecting sensor 21 is performed at a sampling period of 2 msec.

The following specifically describes a method of controlling the rotational phases of the photosensitive drums 3 by the image forming device 100 of the foregoing arrangement.

In forming an image, the photosensitive drum 3 rotates and forms an electrostatic latent image on the transfer belt 7. However, it is often the case that the rotational velocity of the photosensitive drum 3 is not constant, resulting in so-called unevenness in rotation. The main cause of the unevenness in rotation is eccentricity of the photosensitive drum 3. The unevenness in rotation has a period corresponding to each rotation of the photosensitive drum 3. The peripheral velocity of the photosensitive drum 3 shows such changes as represented by a sine curve. This holds true with all the photosensitive drums 3*a* to 3*d*. The rotational phase control of the present invention for the photosensitive drums 3 is the control for synchronizing the phases of unevenness in rotation of the photosensitive drums 3*a* to 3*d*.

In the present embodiment, the black (K) toner image is used as the reference patch image, and the cyan (C) toner image is used as the correction patch image. However, the colors of the toner images used as the reference patch image and the correction patch image are not limited to black (K) and cyan (C); any of the four colors back (K), cyan (C), magenta (M), and yellow (Y) may be used.

The rotational phase control of the present invention for the photosensitive drums 3 is performed by forming the reference patch image and the correction patch image on the transfer belt 7. Each of the reference patch image and the correction patch image consists of a plurality of lines extended in a scanning direction and lined up in the sub-scanning direction. The scanning direction is identical to the traveling direction of the transfer belt 7, and the sub-scanning direction is perpendicular to the traveling direction of the transfer belt 7. In the following description, each line of the reference patch image is referred to as reference line, and each line of the correction patch image is referred to as correction line.

Figure 5:
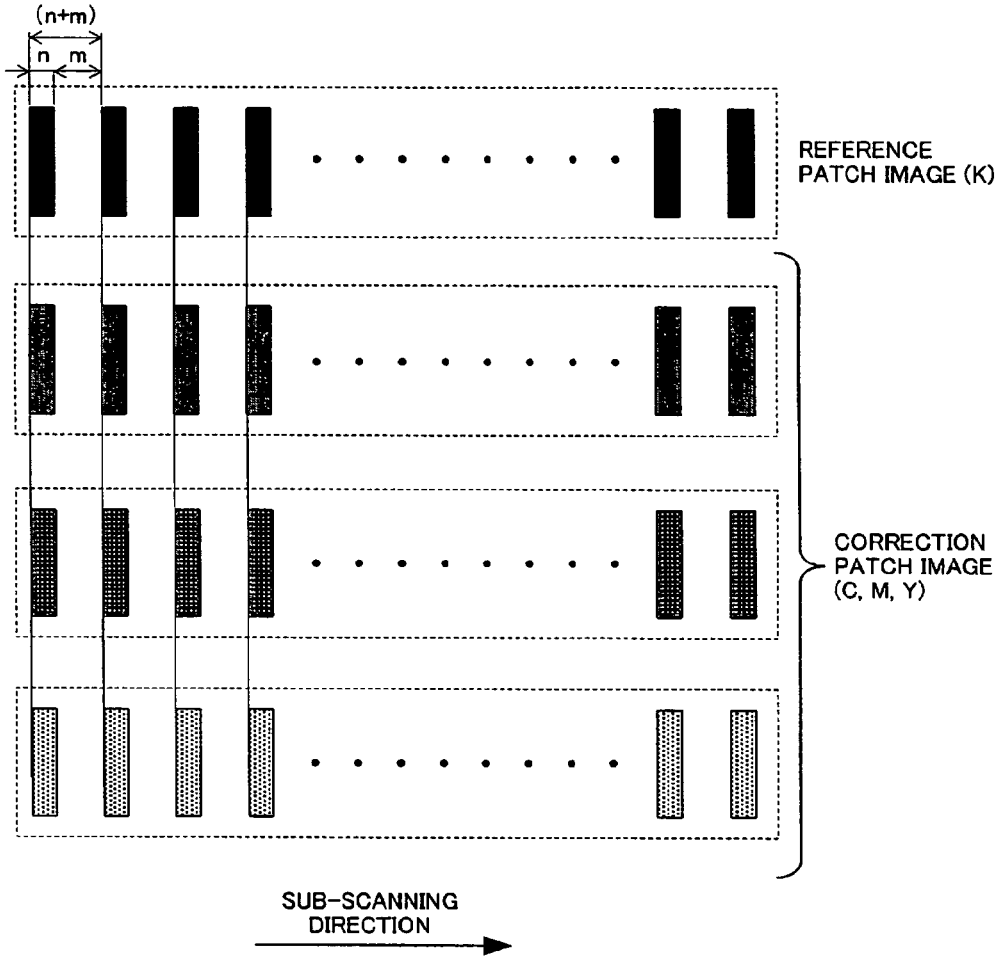
FIG. 5 is a diagram illustrating a reference patch image and a correction patch image formed by the image forming device of one embodiment of the present invention.

FIG. 5 is a diagram illustrating the reference patch image (K) and the correction patch image (C, M, Y). As shown in FIG. 5, each of the reference patch image and the correction patch image is a group pattern (pattern image) consisting of lines of the same width formed at the same pitch. Specifically, the plurality of reference lines and the plurality of correction lines have the same line width n, and are lined up at the same line interval m in the sub-scanning direction. In other words, the reference patch image and the correction patch image are identical group patterns designed to completely overlap when superimposed, if the rotational phases of the photosensitive drums 3 of respective colors are in phase.

Figure 6:
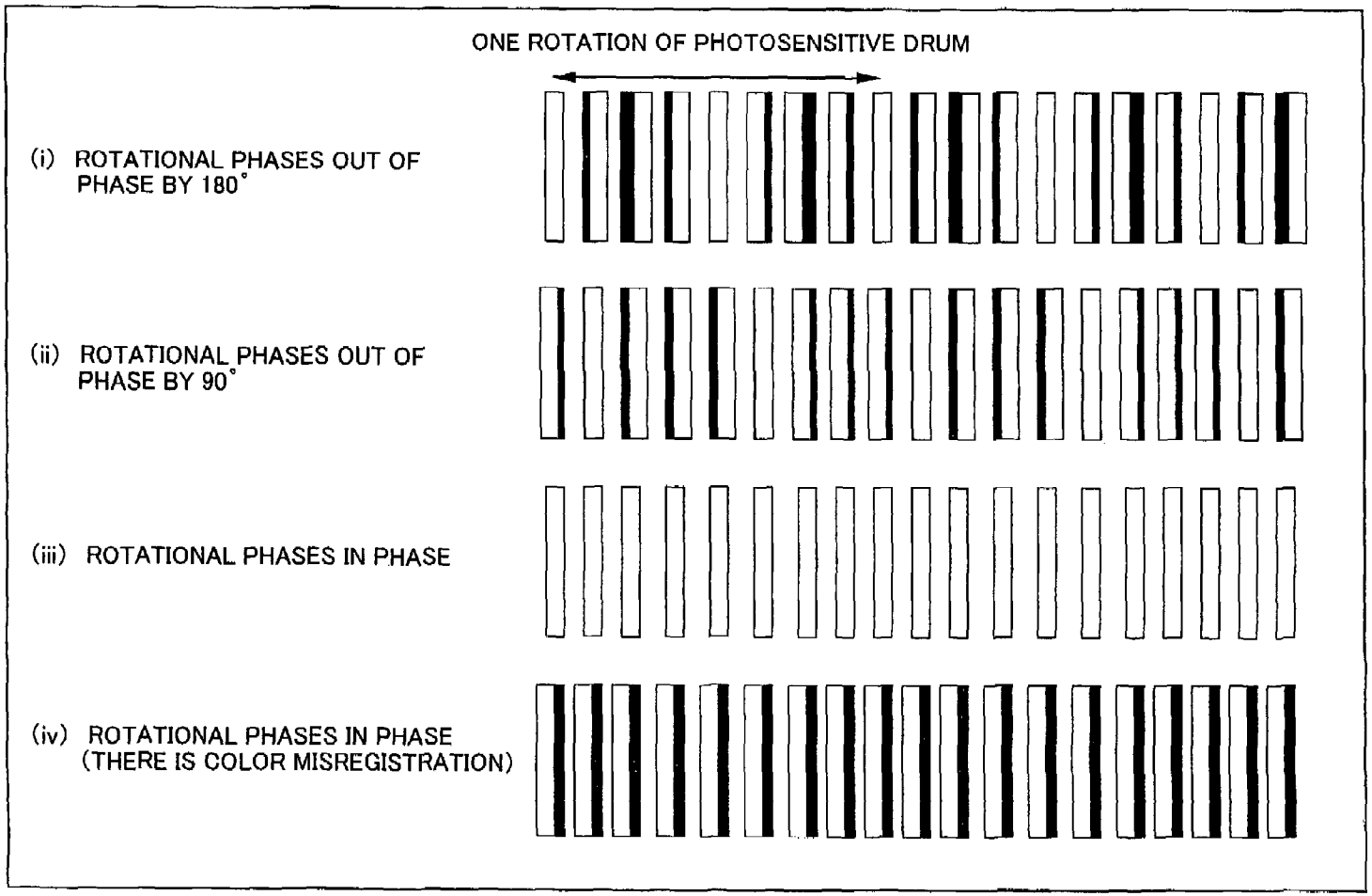
FIG. 6 is a diagram illustrating patterns of one embodiment of the present invention, each pattern being formed by forming the correction patch image on the reference patch image.

In order to control the rotational phase of the photosensitive drum 3, the reference patch image is formed on the transfer belt 7, and then the correction patch image is formed on the reference patch image. FIG. 6 is a diagram illustrating a pattern made by forming the correction patch image on the reference patch image. Even if lines of the same width are formed at the same pitch, the line interval of the resultant patch image is uneven, because the photosensitive drums 3 have unevenness in rotation. Therefore, if the rotational phase of the photosensitive drum for the reference patch image and the rotational phase of the photosensitive drum for the correction patch image are out of phase, the ratio of overlapping parts differs from line to line, even if identical group patterns are superimposed. In other words, if the line interval is uneven, line positions are not completely identical between the two patch images, and, as a result, there are variations in width among the lines formed by superimposition. For example, as shown in FIG. 6, if the rotational phase of the photosensitive drum 3*a* (for black (K)) and the rotational phase of the photosensitive drum 3*b* (for cyan (C)) are out of phase by 180 degrees (see (i) of FIG. 6)), or by. 90 degrees (see (ii) of FIG. 6), the ratio of overlapping parts varies from line to line in the resultant pattern formed by superimposition. As a result, the line width in the resultant pattern varies from line to line. On the other hand, if the rotational phase of the photosensitive drum 3*a* (for black (K)) and the rotational phase of the photosensitive drum 3*b* (for cyan (C)) are in phase, the reference lines and the correction lines completely overlap (see (iii) of FIG. 6) or the group patterns of the identical shapes overlap with disagreement (see (iv) of FIG. 6). That is, if each line formed by a reference line and a correction line is regarded as a single line, the line width varies from line to line if the rotational phases of the photosensitive drums are out of phase. On the other hand, if the rotational phases of the photosensitive drums are in phase, the line width is the same in all the lines. If the reference lines and the correction lines do not overlap completely while the rotational phases of the photosensitive drums are in phase, it means that there is color misregistration. In this case, completely overlapping lines can be formed by performing a color registration correction, as described later.

Next, the registration detecting sensor 21 detects the density average value in a region including the reference lines and the correction lines formed on the transfer belt 7. Specifically, the registration detecting sensor 21 detects, within its reading range, the density average value based on the difference in light amount between (i) reflected light from the transfer belt 7 and (ii) reflected light from the reference lines and the correction lines, among the reflected light from the region including the reference lines and the correction lines formed on the transfer belt 7. The reading range of the registration detecting sensor 21 of the present embodiment is a circular region having a diameter of about 10 mm. Therefore, even if a detection error occurs due to color misregistration caused by minute vibrations or the like, the detection error can be averaged.

For example, if a plurality of reference lines and a plurality of correction lines are formed in the sub-scanning direction at a line width of four dots and at a line interval of seven dots, and the resolution of image formation is 600 dpi, the line pitch is about 0.0423 mm and the pitch of the group pattern is equivalent to 11 lines, i.e. 0.465 mm. That is, the registration detecting sensor 21 reads about 21 group patterns at the same time. The resultant reading signal is naturally an averaged density value. Therefore, no computing process for averaging is required.

The density average value in the region including the reference lines and the correction lines (the density average value is detected by the registration detecting sensor 21) varies depending on the degree of overlap between the reference lines and the correction lines on the transfer belt 7. In other words, the amount of reflected light detected by the registration detecting sensor 21 varies depending on how much the reference lines and the correction lines overlap with each other. That is to say, the result of detection by the registration detecting sensor 21 varies according to the total area of the reference lines and correction lines formed on the surface of the transfer belt 7. When the total area is minimum, that is, if the reference lines and the correction lines completely overlap, the amount of light absorbed by the reference lines and the correction lines out of the light emitted from the registration detecting sensor 21 becomes minimum. In other words, the amount of reflected light from the transfer belt 7 becomes maximum. Therefore, the density average value detected by the registration detecting sensor 21 becomes a high value. If a transparent transfer belt is used instead of the transfer belt 7, detection can be performed in the same manner by using a transmissive registration detecting sensor, instead of the reflective registration detecting sensor 21.

Figure 7:
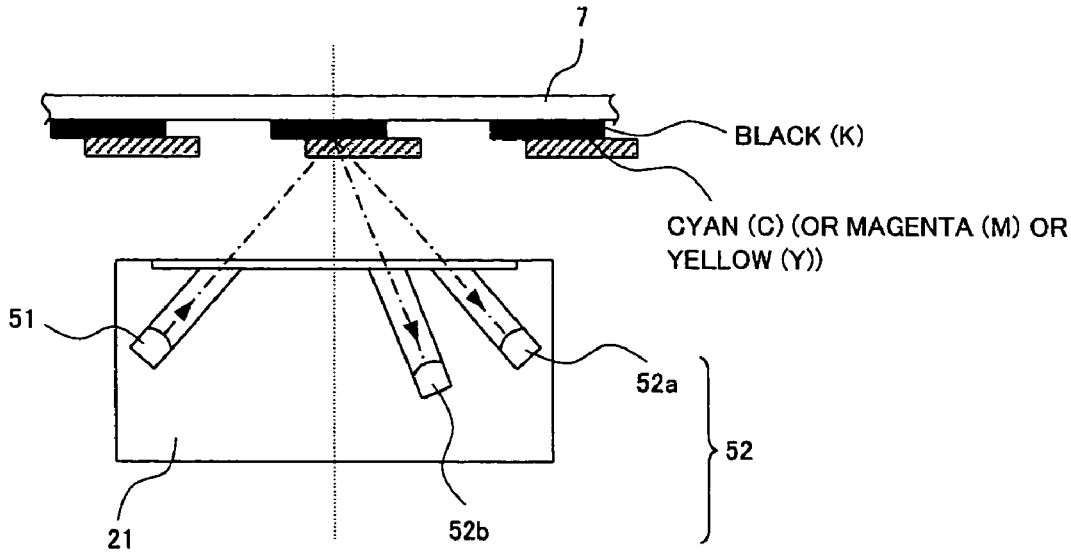
FIG. 7(*a*) is a cross-sectional view schematically illustrating a method of one embodiment of the present invention, for detecting a density average value by using a registration detecting sensor.
Figure 7:
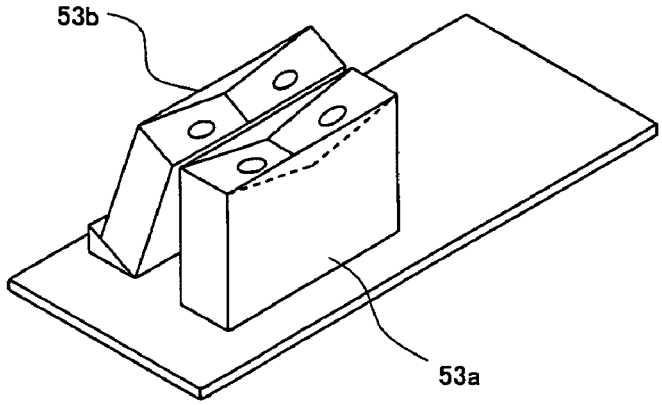

FIG. 7(*a*) is a diagram schematically illustrating a method of detecting the density average value by using the registration detecting sensor 21. As shown in FIG. 7(*a*), the registration detecting sensor 21 has a light-emitting section 51 and a light-receiving section 52. The light emitted from the light-emitting section 51 is reflected on the region including the reference lines and the correction lines formed on the transfer belt 7, and the reflected light is received by the light-receiving section 52. Then, based on the amount of the received light, the density average value is detected. The light-receiving section 52 includes a regular reflected light receiving section 52*a* and a diffuse reflected light receiving section 52*b*. The regular reflected light receiving section 52*a* receives light reflected by regular reflection, out of the light reflected on the region including the reference lines and the correction lines formed on the transfer belt 7. The diffuse reflected light receiving section 52*b* receives light reflected by diffuse reflection, out of the light reflected on the region including the reference lines and the correction lines formed on the transfer belt 7. The light-receiving section 52 separately receives light beams reflected at different angles. The regular reflected light receiving section 52*a* is provided at a position where the light reflected by regular reflection can be received directly. The diffuse reflected light receiving section 52*b* is provided at a position where the light reflected by regular reflection cannot be received directly. Thus, the regular reflected light receiving section 52*a* and the diffuse reflected light receiving section 52*b* are provided at different angles, so as to receive regular reflected light and diffuse reflected light, respectively. This is because, at the time of the process control, the regular reflected light receiving section 52*a* is used for achromatic color (black), and the diffuse reflected light receiving section 52*b* is used for chromatic color (e.g. cyan), and because, in the present embodiment, the registration detecting sensor 21 is used for the process control, color registration control, and rotational phase control. In order to perform the color registration control and/or the rotational phase control of the present invention, it is sufficient if either one of the regular reflected light receiving section and the diffuse reflected light receiving section is used. In the present embodiment, the regular reflected light receiving section is used. Unlike the special sensor of FIG. 7(*a*), in which the regular reflected light receiving section 52*a* and the diffuse reflected light receiving section 52*b* are integrated into one sensor case, the sensor used in FIG. 7(*b*) is a multipurpose sensor including one light-emitting section and one light-receiving section in each sensor case. In FIG. 7(*b*), identical multipurpose sensors are provided on a substrate at different angles. One is used as a sensor 53*a* for regular reflected light, and the other is used as a sensor 53*b* for diffuse reflected light.

Figure 8:
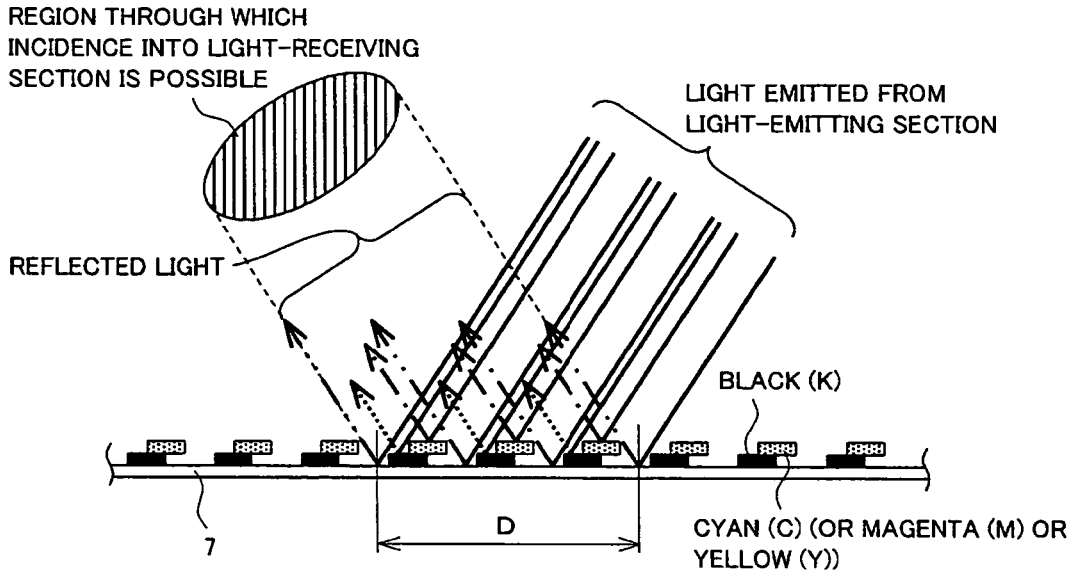
FIGS. 8(*a*) and 8(*b*) are cross-sectional views illustrating light radiated onto the transfer belt and light reflected on the transfer belt.
Figure 8:
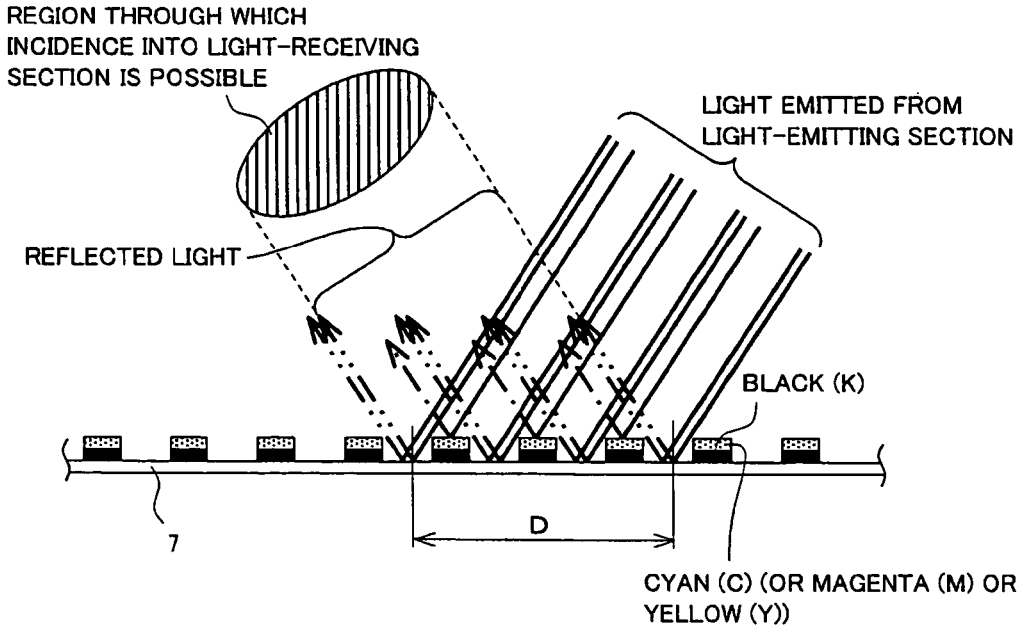

As described above, the light emitted from the light-emitting section 51 of the registration detecting sensor 21 is reflected on the region including the reference lines and the correction lines formed on the transfer belt 7, and the reflected light is received by the receiving section 52. At this time, as shown in FIG. 8(*a*), the light emitted from the light-emitting section 51 is radiated into a certain range on the transfer belt 7. The certain range (hereinafter "radiation range D") is the region including the reference lines and the correction lines on the transfer belt 7. Therefore, the light emitted from the light-emitting section 51 is reflected on the reference lines, the correction lines, and the transfer belt 7 within the radiation range D. In FIG. 8(*a*), the light reflected on the reference lines (black) is indicated by dotted lines; the light reflected on the correction lines (cyan) is indicated by chain lines; and the light reflected on the transfer belt 7 is indicated by chain double-dashed lines. The length of each arrow of reflected light indicates light intensity. The light intensity is the highest in the light reflected on the surface of the transfer belt 7, the second highest in the light reflected on the correction lines, and the lowest in the light reflected on the reference lines. The light reflected on the reference lines is received by the regular reflected light receiving section 52*a*, and the light reflected on the correction lines is received by the diffuse reflected light receiving section 52*b*. As a result, the density average value is detected.

FIG. 8(*b*) illustrates the case where the reference lines and the correction lines overlap completely. In this case, there is no reflected light from the reference lines. Therefore, the light emitted from the light-emitting section 51 becomes either the light reflected by the correction lines (chain lines) or the light reflected by the transfer belt 7. Because there is no reflected light from the reference lines, the intensity of the light reflected on the transfer belt 7 becomes the strongest.

Figure 9:
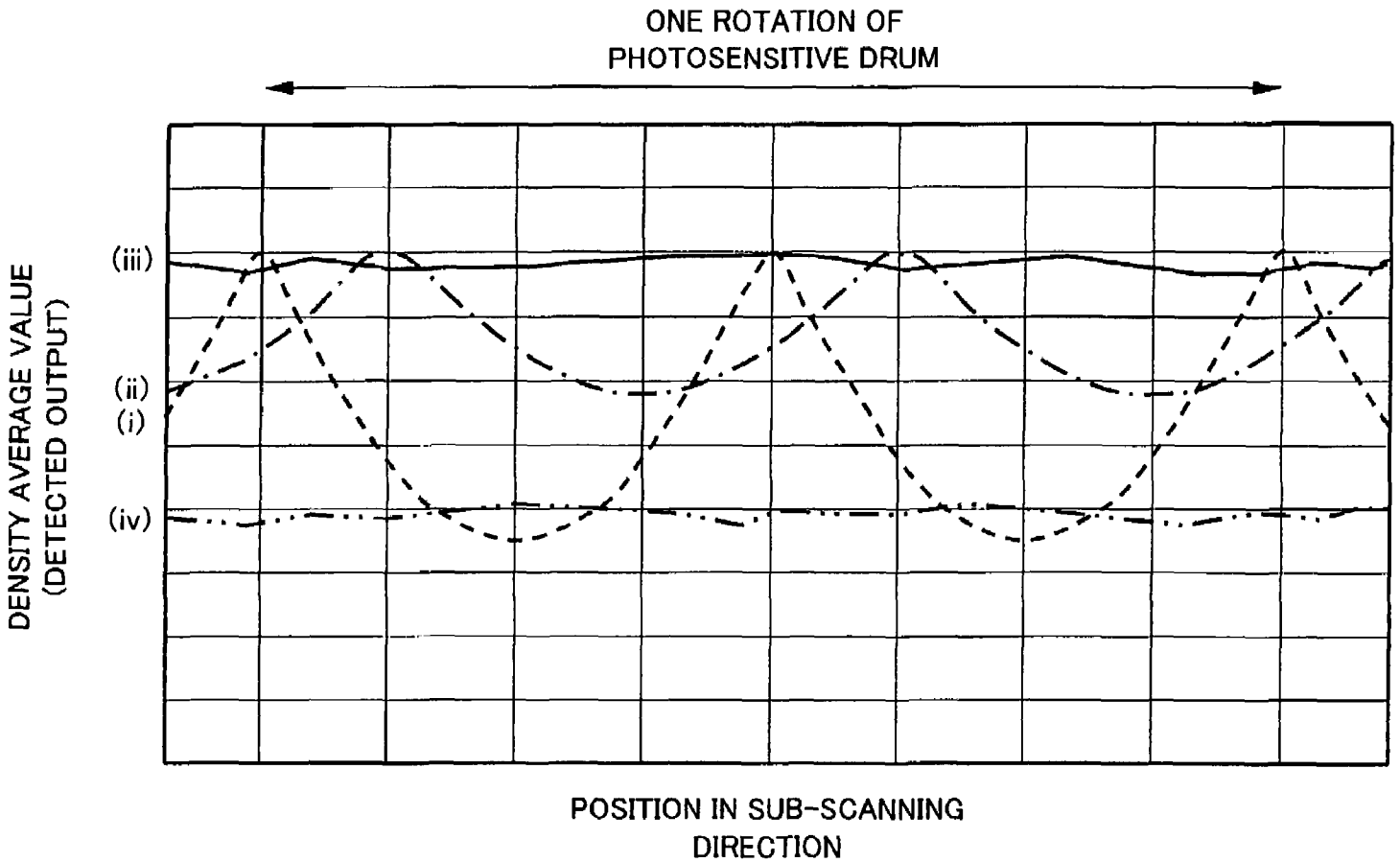
FIG. 9 is a graph illustrating the density average value detected by the registration detecting sensor of one embodiment of the present invention.

FIG. 9 is a graph illustrating the density average value detected by the registration detecting sensor 21. In the graph of FIG. 9, (i) to (iv) respectively correspond to (i) to (iv) of FIG. 6. If the rotational phase of the photosensitive drum 3*a*, which is to be a reference point, and the rotational phase of the photosensitive drum 3*b*, which is a target of correction, are out of phase (see (i) and (ii)), the detected density average value changes periodically. If the rotational phases of the photosensitive drums 3*a* and 3*b* are out of phase, the reference patch image and the correction patch image do not overlap evenly. Therefore, as shown in (i) and (ii) of FIG. 6, the overlap between the reference lines and the correction lines varies from line to line. As a result, the amount of reflected light changes periodically. This is why the detected density average value changes periodically.

On the other hand, if the rotational phases of the photosensitive drums 3*a* and 3*b* are in phase (see (iii) and (iv)), the detected density average value is nearly constant throughout one rotation of the photosensitive drums 3*a* and 3*b*. If the rotational phases of the photosensitive drums 3*a* and 3*b* are in phase, the reference lines and the correction lines completely overlap, or the group images of the identical shapes overlap with disagreement, as shown in (iii) and (iv) of FIG. 6. Therefore, the amount of reflected light from each line is nearly constant. This is why the detected density average value is nearly constant throughout one rotation of the photosensitive drums 3*a* and 3*b*. Therefore, in the present invention, the rotational phases of the photosensitive drums 3 should be controlled so that the density average of (iii) or (iv) shown in FIG. 9 is obtained as a result of measurement performed by the registration detecting sensor 21 after the reference patch image and the correction patch image are superimposed. The density average value differs between (iii) and (iv) shown in FIG. 9, because the reference patch image and the correction patch image completely overlap in the former, while they overlap with disagreement in the latter. In the case where there is color misalignment, the amount of reflected light is small because the line area is large. Therefore, the density average value is small.

Next, the rotational phase of the correction-target photosensitive drum 3*b* (the photosensitive drum that is the target of correction; corresponds to cyan), is shifted by a predetermined angle without changing the rotational phase of the photosensitive drum 3*a*, which is to be the reference point (which corresponds to black (K)). After that, the reference patch image and the correction path image are formed, and the density average value is measured. The density average value is measured after the rotational phase of the correction-target photosensitive drum 3*b* is shifted by a predetermined angle, and this operation is repeated until one rotation of the photosensitive drum 3*b* is completed.

Figure 10:
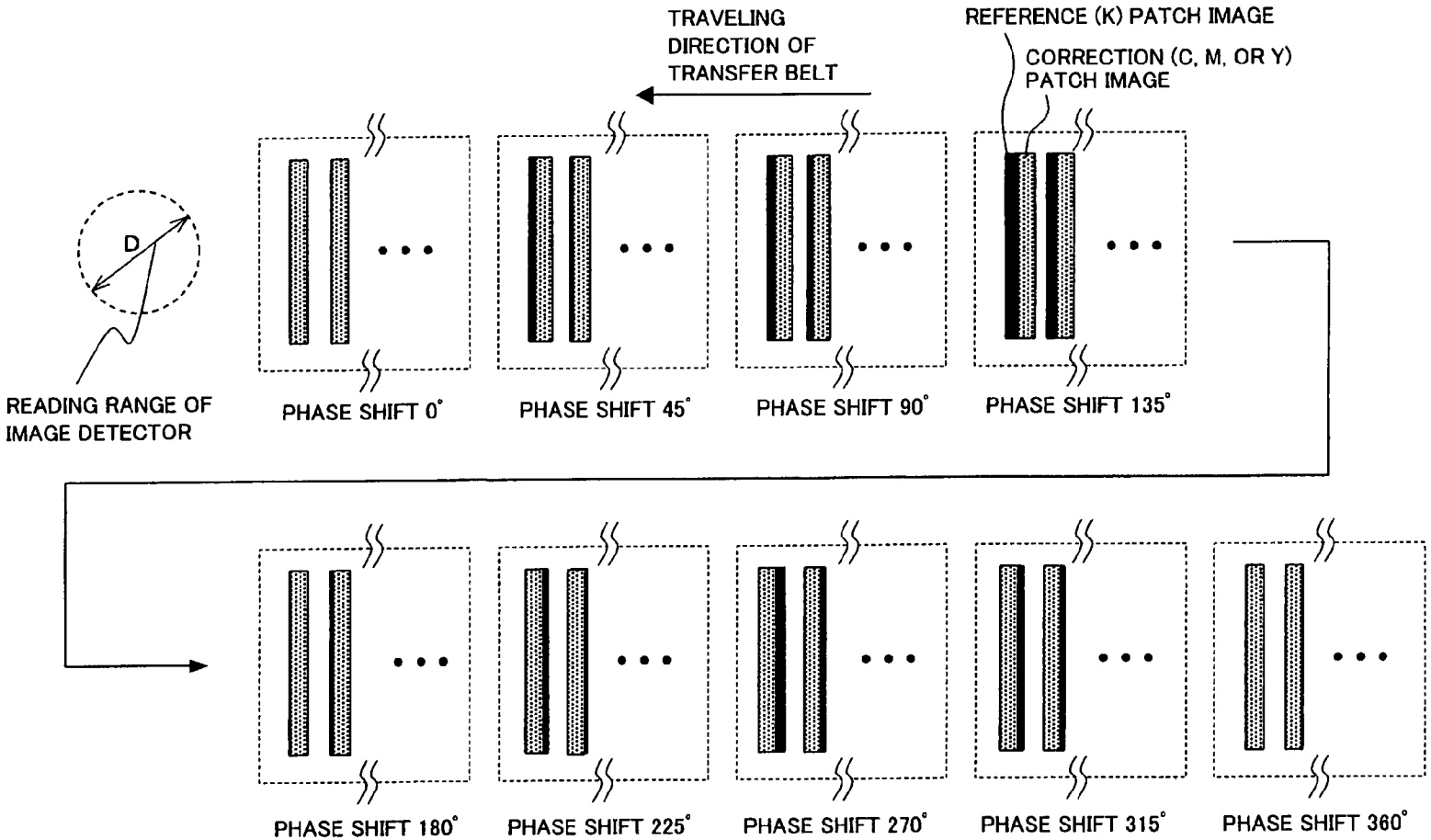
FIG. 10, which relates to one embodiment of the present invention, is a diagram illustrating patterns each of which consists of the reference patch image and the correction patch image formed after the rotational phase of a correction-target photosensitive drum is shifted by 45 degrees.

FIG. 10 is a diagram illustrating an example in which the photosensitive drum 3*b* is shifted by 45 degrees before each formation of the reference patch image and the correction patch image. As shown in FIG. 10, if the rotational phase of the correction-target photosensitive drum 3*b* is shifted, the degree of overlap between the reference patch image and the correction patch image changes. Therefore, as the rotational phase of the correction-target photosensitive drum 3*b* is shifted, the detected density average value also changes. In FIG. 10, the reference patch image and the correction patch image completely overlap in the case where the rotational phase of the correction-target photosensitive drum 3*b* is shifted by 0 degrees (360 degrees).

Next, the correction value to be used for the rotational phase control is calculated in accordance with the density average value detected by the registration detecting sensor 21. The correction value is correction data used for controlling the rotational phase of a correction-target photosensitive drum so that the rotational phase of the correction-target photosensitive drum is synchronized with the rotational phase of a reference photosensitive drum (photosensitive drum that is to be the reference point). In order to calculate the correction value, first, the control section 23 compares the density average values obtained by shifting the rotational phase of the photosensitive drum by a predetermined angle as shown in FIG. 10. In this way, the control section 23 identifies a rotational phase at which the amplitude of the density average value is the smallest. The amplitude of the density average value is a difference between the maximum density value and the minimum density value of the density average value. The control section 23 then calculates the correction value in accordance with the condition (i.e. rotational phase) with which the correction patch image is formed at the smallest amplitude. The rotational phase that minimizes the difference between the maximum density value and the minimum density value is the rotational phase at which the amount of disagreement between the reference patch image and the correction patch image is the smallest. Therefore, the control section 23 calculates the correction value for the rotational phase of the correction-target photosensitive drum 3*b* in accordance with the state in which the rotational phases are synchronized to the greatest extent. After being calculated, the correction value is stored in the correction value storing section 49. The correction value is updated if a more appropriate correction value is calculated later. These steps for calculating the correction value are performed in the same manner for all the correction-target photosensitive drums. Specifically, in the present embodiment, these steps for calculating the correction value are performed in the same manner for the photosensitive drum 3*c*, which corresponding to magenta (M), and for the photosensitive drum 3*d*, which corresponds to yellow (Y). As a result, it is possible to adjust the color misregistration caused by the unevenness in rotation of the photosensitive drums.

Instead of the foregoing method, the correction value may be calculated by the following method. In order to control the rotational phases of the photosensitive drums, an acceptable amplitude of the density average value (difference between the maximum density value and the minimum density value) is set in advance. Each time the rotational phase of the correction-target photosensitive drum 3*b* is shifted by a predetermined angle and the density average value is measured, the control section 23 judges whether or not the amplitude of the detected density average value exceeds the acceptable amplitude. If the amplitude of the detected density average value does not exceed the acceptable amplitude, the control section 23 calculates the correction value for the correction-target photosensitive drum 3*b* in accordance with the rotational phase at which the amplitude is attained. If the amplitude of the detected density average value exceeds the acceptable amplitude, the rotational phase of the correction-target photosensitive drum 3*b* is shifted again by the predetermined angle, and the density average value is measured. Then, the amplitude of the detected density average value is compared with the acceptable amplitude. These steps are repeated until the detection of such a rotational phase at which the amplitude of the density average value does not exceed the acceptable amplitude. These steps for calculating the correction value are performed in the same manner for all the correction-target photosensitive drums (specifically, in the present embodiment, the photosensitive drum 3*c*, which corresponding to magenta (M), and the photosensitive drum 3*d*, which corresponds to yellow (Y)).

It is preferable if the reference patch image and the correction patch image, which are used for calculating the correction value, are formed in such a length that corresponds to one rotation of the photosensitive drum. However, the correction value can be calculated if the reference patch image and the correction patch image are formed in such a length that corresponds to at least a half of one rotation. As shown in FIG. 9, the density average value of the reference patch image and the correction patch image have at least two peaks at which the density average value is maximum, and at least two peaks at which the density average value is minimum. Therefore, if the photosensitive drum is rotated by one-half or more, at least one peak at which the density average value is maximum, and at least one peak at which the density average value is minimum, are included.

In order to calculate the correction value, the amplitudes of the density average values needs to be compared. Therefore, it is necessary to detect at least one peak at which the density average value is maximum, and at least one peak at which the density average value is minimum. Therefore, the correction value can be calculated if the density average value is calculated after the reference patch image and the correction patch image are formed by rotating the photosensitive drum by one-half or more.

Described next is a method by which the control section 23 controls the rotational phases of the photosensitive drums 3*a* to 3*d* by using the correction value calculated as described above.

Figure 11:
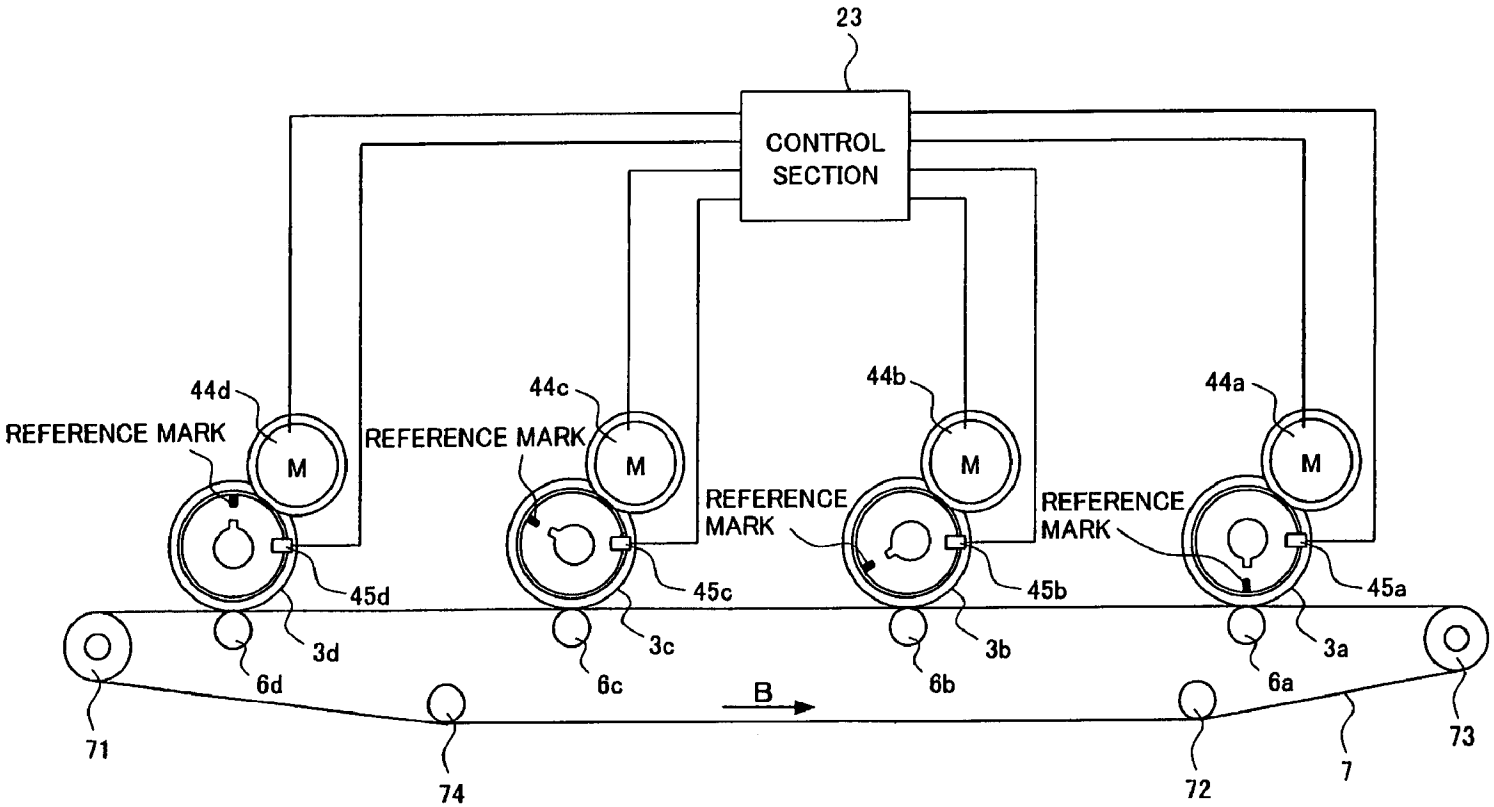
FIG. 11 is a schematic diagram illustrating an arrangement of one embodiment of the present invention, for controlling the rotational phases of photosensitive drums.

FIG. 11 is a schematic block diagram illustrating an arrangement for controlling the rotational phases of the photosensitive drums 3*a* to 3*d* by using the correction value. As shown in FIG. 11, the photosensitive drums 3*a* to 3*d* are respectively connected to driving motors 44*a* to 44*d*, and are rotationally driven by the driving motors 44*a* to 44*d*, respectively. The driving motors 44*a* to 44*d* are stepping motors, for example. The photosensitive drums 3*a* to 3*d* are respectively provided with photosensitive drum position detecting sensors 45*a* to 45*d*. In the following description, the four driving motors (44*a*, 44*b*, 44*c*, and 44*d*) respectively provided for the four colors are collectively referred to as driving motors 44, and the four photosensitive drum position detecting sensors (45*a*, 45*b*, 45*c*, and 45*d*) respectively provided for the four colors are collectively referred to as photosensitive drum position detecting sensors 45.

In each photosensitive drum 3, the relative locations of the photosensitive drum position detecting sensor 45 and of the transfer position is the same. The photosensitive drum position detecting sensor 45 detects the rotational position of the photosensitive drum 3 by detecting the position of the reference mark on the photosensitive drum 3. Each photosensitive drum position detecting sensor 45 transmits its output to the control section 23. In accordance with the outputs from the photosensitive drum position detecting sensors 45, the control section 23 controls the driving motors 44. In terminating image formation, the control section 23 stops each photosensitive drum 3 accurately at a stop position of the photosensitive drum 3 in accordance with the result of detection performed by the photosensitive drum position detecting sensor 45. In starting image formation, the control section 23 controls the driving motors 44 so that the photosensitive drums 3 simultaneously start rotating.

At the time of image formation, the photosensitive drums 3 simultaneously start rotating, and simultaneously stop rotating. Therefore, by performing such control as to stop the photosensitive drums 3 at respective stop positions (rotation start positions), it is possible to rotate the photosensitive drums 3 at controlled rotational phases (in a state in which rotational phases of adjacent photosensitive drums 3 are different by a predetermined angle) at the time of image formation.

In order to synchronize the rotational phases of the photosensitive drums 3, which are respectively provided in the image forming stations, and perform image formation while keeping the rotational phases always in phase, the stop position of each photosensitive drum 3 is controlled in stopping the photosensitive drums 3 after the image formation is completed. The control (hereinafter "phase-synchronizing stop control") is performed by using the photosensitive drum position detecting sensors 45, in accordance with the stored correction value. In this case, the photosensitive drums 3 stop in such a state that the rotational phases are in phase at the beginning of the next rotation. In performing image formation, the photosensitive drums 3 are controlled so as to start rotating simultaneously from this halt state, and so as to keep the in-phase state of the rotational phases from the rise of rotation until a steady number of rotation is attained. This control is referred to as "phase-keeping control". The phase-synchronizing stop control and the phase-keeping control are performed by using the driving motors 44, which are provided to the photosensitive drums 3 respectively and independently. The diving motors 44 are stepping motors. Therefore, the photosensitive drums 3 can be driven at the same rotational pattern throughout the stages of rise of rotation, fall of rotation, and steady rotation. As a result, the photosensitive drums 3 can be controlled without requiring a complex mechanism.

The rotational phase control for the photosensitive drums 3 is not limited to the foregoing method. For example, if the photosensitive drums 3 stop while the rotational phases are out of phase, the rotational phase control may be performed as follows, for example: (1) detect the rotational phases of the photosensitive drums 3 by using the photosensitive drum position detecting sensor 45 after the photosensitive drums 3 start rotating, and (2) synchronize, with the rotational phase of the reference photosensitive drum, the rotational phase of the other photosensitive drums in accordance with the stored correction values, before image formation is started. This control is referred to as "phase-synchronizing rotation control"). Here again, the rotational phase control for the photosensitive drums 3 can be performed by using the driving motors 45.

In the foregoing manner, images can be formed while the rotational phases of the photosensitive drum 3 in the image forming device 100 are under control. However, even in this case, there is a case where an image is formed with disagreement among the colors K, C, M, and Y (as shown in the case of (iv) in FIG. 6, where the reference patch image and the correction patch image, which are group patterns of identical shapes, overlap with certain disagreement). In this case, by performing color registration correction for adjusting registration among colors, it is possible to form an image in which the colors overlap completely. The color registration adjustment is described below.

The color registration correction can be performed by using the reference patch image and the correction patch image formed to control the rotational phases of the photosensitive drums 3. The timing for forming the correction patch image on the reference patch image is shifted each time by a predetermined amount, and the density average value is detected by using the registration detecting sensor 21. The less the color misalignment is, the larger the density average value is; the more the color misalignment is, the smaller the density average value is. Therefore, the density average values are compared, and the timing for forming the color that is a target of color misregistration correction is controlled in accordance with the condition in which the correction patch image having the largest density average value is formed. These steps are performed in the same manner for all the colors that are targets of color misregistration correction.

The rotational phase control for the photosensitive drums and the color registration correction may be performed as a set, or maybe performed separately. If the rotational phase control for the photosensitive drums and the color registration correction are performed as a set, and the latter is performed after the former is completed, it is possible to perform the color registration while the phases of unevenness in rotation of the photosensitive drums are in phase. Therefore, a more excellent image can be formed. If the color registration is performed before the rotational phase control for the photosensitive drums is performed, it is possible to perform the rotational phase control for the photosensitive drums while there is little color misalignment.

Figure 12:
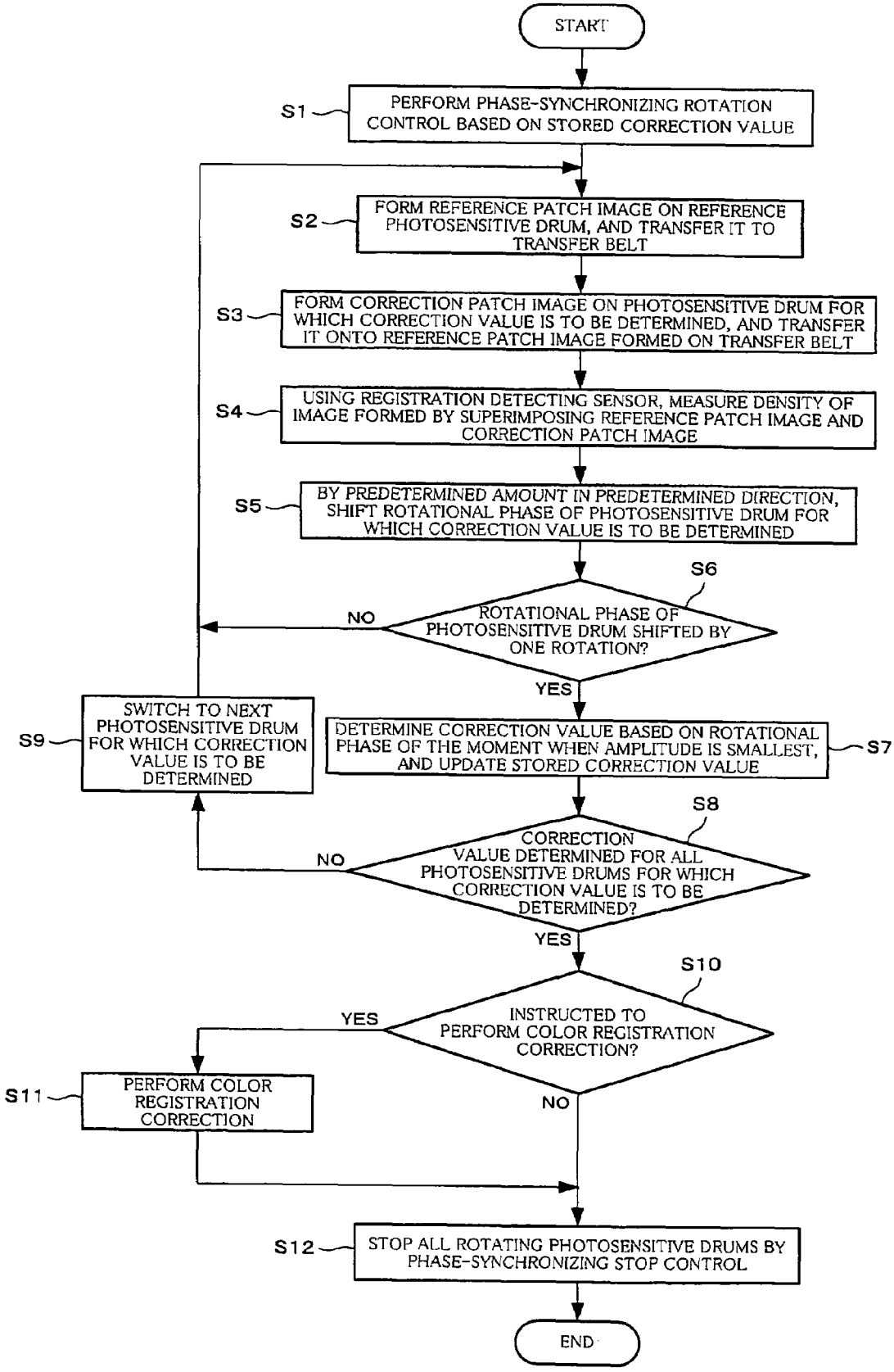
FIG. 12 is a flowchart illustrating rotational phase control for the photosensitive drums and color registration correction in one embodiment of the present invention.

FIG. 12 is a flowchart illustrating the rotational phase control for the photosensitive drums 3 and the color registration correction performed in the image forming device 100.

First, in accordance with the correction value stored in the correction value storing section 49, the phase-synchronizing rotation control is performed (S1). Next, the reference patch image is formed on the reference photosensitive drum 3*a*, and then transferred to the transfer belt 7 (S2). On the photosensitive drum 3*b*, for which a correction value is to be calculated, the correction patch image is formed, and transferred onto the reference patch image, which is on the transfer belt 7 (S3). Then, by using the registration detecting sensor 21, the density of the pattern formed by superimposing the reference patch image and the correction patch image is detected (S4). Next, the rotational phase of the photosensitive drum 3*b*, for which a correction value is to be calculated, is shifted by a predetermined amount (S5). Then, it is judged whether or not the rotational phase of the photosensitive drum 3*b* has been shifted by one rotation (S6). If the rotational phase of the photosensitive drum 3*b* has not been shifted by one rotation, S2 to S5 are performed again. If the rotational phase of the photosensitive drum 3*b* has been shifted by one rotation, S7 is performed.

In S7, the densities obtained by shifting the rotational phase by the predetermined amount before each measurement are compared, and the rotational phase at which the amplitude of the measured density (the difference between the maximum density value and the minimum density value) is the smallest is identified. Then, the correction value is calculated in accordance with the rotational phase, and the stored correction value is updated. Next, it is judged whether or not correction values for the photosensitive drums 3*c* and 3*d*, which are the other targets, have been calculated (S8). If the correction values for the photosensitive drums 3*c* and 3*d* have not been calculated, the target is switched to the photosensitive drums 3*c* or 3*d*, which is the next target (S9). Then, S2 to S8 are performed. If it is judged in S8 that the correction values for all the photosensitive drums 3*b* to 3*d* have been calculated, S10 is performed.

In S10, it is judged whether or not there is an instruction to perform the color registration correction. As a result of judgment, if there is an instruction, the color registration correction is performed (S11), and then S12 is performed. If there is no instruction, S12 is performed right after S10. In S12, all the photosensitive drums 3 are stopped in accordance with the correction values obtained.

Figure 13:
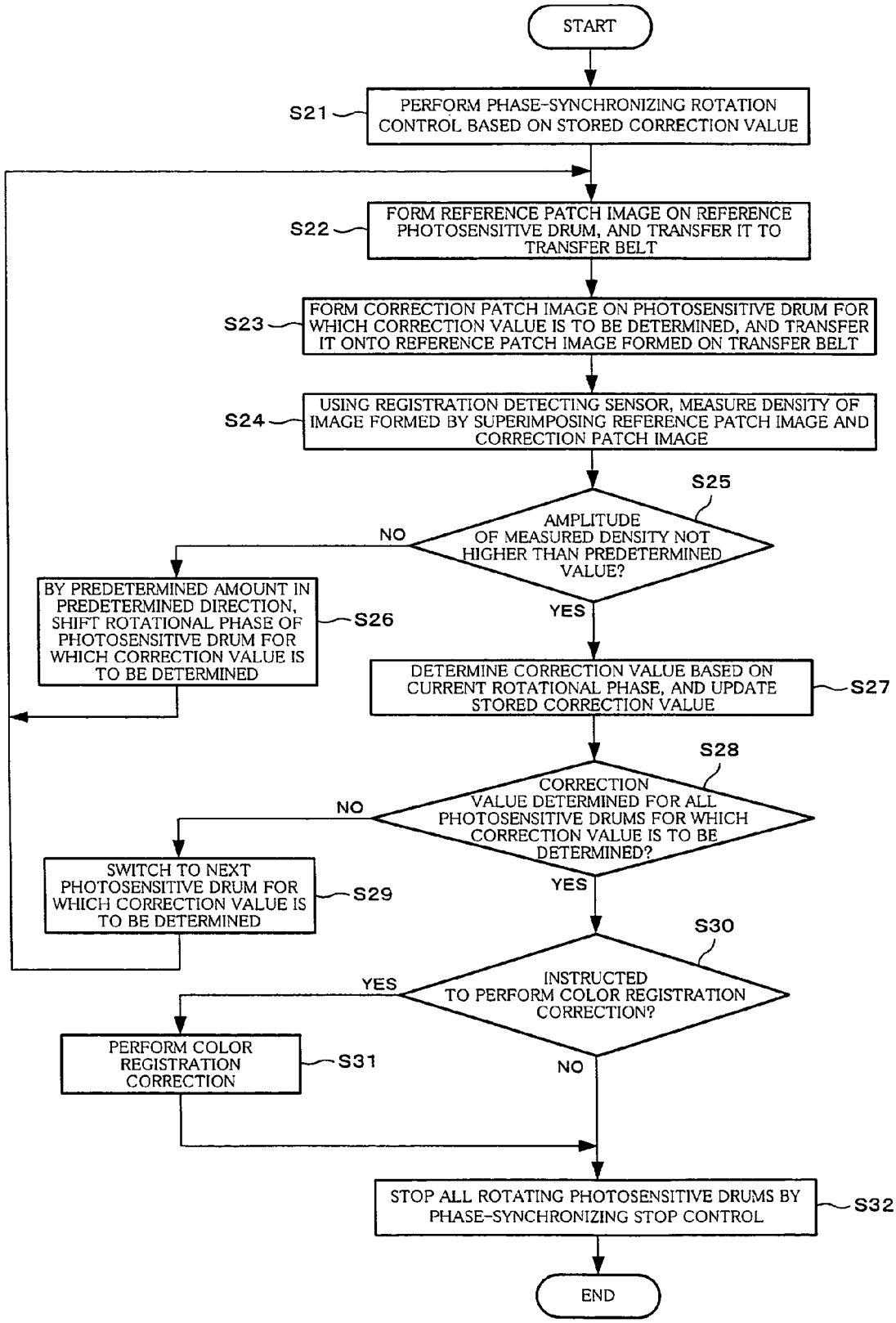
FIG. 13 is another flowchart illustrating rotational phase control for the photosensitive drums and color registration correction in one embodiment of the present invention.

FIG. 13 is a flowchart different from FIG. 12, illustrating the rotational phase control for the photosensitive drums 3 and the color registration correction performed in the image forming device 100.

First, in accordance with the correction value stored in the correction value storing section 49, the phase-synchronizing rotation control is performed (S21). Next, the reference patch image is formed on the reference photosensitive drum 3*a*, and then transferred to the transfer belt 7 (S22). On the photosensitive drum 3*b*, for which a correction value is to be calculated, the correction patch image is formed, and transferred onto the reference patch image, which is on the transfer belt 7 (S23). Then, by using the registration detecting sensor 21, the density of the pattern formed by superimposing the reference patch image and the correction patch image is detected (S24). Next, it is judged whether or not the amplitude of the density value measured in S24 (the difference between the maximum density value and the minimum density value) exceeds a predetermined value (S25). If the amplitude exceeds the predetermined value, the rotational phase of the photosensitive drum 3*b*, for which the correction value is to be calculated, is shifted by a predetermined amount (S26), and S22 to S25 are performed. If it is judged in S25 that the amplitude does not exceed the predetermined value, S27 is performed.

In S27, a correction value is calculated in accordance with the rotational phase at which the amplitude does not exceed the predetermined value, and the stored correction value is updated. Then, S28 is performed. In S28, it is judged whether or not correction values for the photosensitive drums 3*c* and 3*d*, which are the other targets, have been calculated. If the correction values for the photosensitive drums 3*c* and 3*d* have not been calculated, the target is switched to the photosensitive drums 3*c* or 3*d*, which is the next target (S29). Then, S22 to S28 are performed. If it is judged in S28 that the correction values for all the photosensitive drums 3*b* to 3*d* have been calculated, S30 is performed.

In S30, it is judged whether or not there is an instruction to perform the color registration correction. As a result of judgment, if there is an instruction, the color registration correction is performed (S31), and then S32 is performed. If there is no instruction, S32 is performed right after S30. In S32, all the photosensitive drums 3 are stopped in accordance with the correction values obtained.

It is preferable if the correction values are calculated and stored in the image forming device by performing the rotational phase control of the present invention for the photosensitive drums on the following occasions, for example: after the image forming device is assembled, after the image forming device is installed to a place of actual use, after members of the image forming device are replaced, and/or after the maintenance of the image forming device.

The rotational phase control for the photosensitive drums may be performed before performing image formation while the power of the image forming device is ON, or may be performed at every elapse of a predetermined time. In the case where the rotational phase control is performed at every elapse of a predetermined time, the predetermined time may be set appropriately (e.g. two hours after the power-ON of the image forming device). The rotational phase control may be performed every time a predetermined number of sheets have been consumed for image formation. In this case, an appropriate setting is to count the number of sheets consumed for image formation, and to perform the rotational phase control every time the number reaches 1000, for example.

It is preferable if a service person or an administrator (user) can forcibly perform, from the operating section, the rotational phase control of the present invention for the photosensitive drums, on the following occasions, for example: after the maintenance (e.g. replacement of process units such as photosensitive drums or developing units), or when salient color misregistration is found in an image formed.

Except in the case of the rotational phase control at the time of power-ON, and the case of the forcible rotational control, the rotational phase control may be performed immediately after the condition for performing the rotational phase control are satisfied. However, if images are formed successively, for example, it is preferable not to interrupt image formation. In this case, it is preferable to delay the timing of the rotational phase control so that the rotational phase control is performed after the image formation job under execution is completed, or before the start of the next image formation job.

The temperature and moisture sensor provided in the image forming device detects the temperature and moisture in the image forming device. Therefore, it is often the case that the temperature and moisture sensor is provided in the vicinity of the process section, where no rapid temperature change or moisture change occurs. Therefore, the rotational phase control may be performed, for example, when a temperature or a moisture that exceeds a predetermined temperature or moisture is detected by the temperature and moisture sensor, and/or when a rapid temperature change or moisture change is detected by the temperature and moisture sensor.

Alternatively, the arrangement may be simply that a service person or an administrator can easily perform the rotational phase control for the photosensitive drums as need arises. This arrangement is economically advantageous, because this arrangement reduces the number of images that need to be formed to perform the rotational phase control (images whose densities are to be detected in order to calculate correction values).

The process control, the rotational phase control for the photosensitive drums, and the color registration correction may be performed separately, or may be performed as a set. If they are performed as a set, the order is not limited. However, it is preferable if the process control is performed first, the rotational phase control for the photosensitive drums is performed secondly, and the color registration correction is performed thirdly. This is because the process control is control for keeping the toner density for image formation always at a predetermined density. By adopting this order, it is possible to adjust images efficiently at high accuracy.

In addition to the foregoing arrangement, the image forming device of the present invention may be such that the images of different color components are (i) pattern images in which a predetermined number of line images extending in a main scanning direction are provided at a predetermined interval, and (ii) identical patterns formed in accordance with the same image data. Likewise, in addition to the foregoing arrangement, the color misregistration correction method of the present invention may be such that the images of different color components are (i) pattern images in which a predetermined number of line images extending in a main scanning direction are provided at a predetermined interval, and (ii) identical patterns formed in accordance with the same image data.

According to this arrangement, because the images of different color components are identical patterns formed in accordance with the same image data, differences among the rotational phases of the image supporting bodies (the differences are caused by the unevenness in rotation of the image supporting bodies) can be found easily by superimposing the images of different color components.

In addition to the foregoing arrangement, the image forming device of the present invention may be such that each of the plurality of group images is formed by transferring one image from a reference image supporting body (an image supporting body that is to be a reference point) to the transfer supporting body, and transferring another image from a control-target image supporting body (an image supporting body whose rotational phase is to be controlled) onto said one image by superimposition.

According to this arrangement, what is measured is the density of each group image formed by superimposing (i) the image formed on the control-target image supporting body onto (ii) the image formed on the reference image supporting body. The density varies significantly within the group image. Therefore, it is easy to detect the density variation within the group image. As a result, the rotational phase control can be performed stably. Moreover, it is possible to ascertain the relationship between (i) the phase of unevenness in rotation of the reference image supporting body and (ii) the phase of unevenness in rotation of the control-target image supporting body, based on the value obtained by measuring the group image. Therefore, no such operation as computing is required. Furthermore, because images of two colors are superimposed, it is sufficient if three kinds of group images (KC, KM, and KY) are formed, in the case of a four-color (KCMY) image forming device.

In addition to the foregoing arrangement, the image forming device of the present invention may be such that the density detecting device detects the density average value by receiving reflected light including (i) light reflected within a predetermined region on a group image formed by superimposing the images of different color components and (ii) light reflected within the predetermined region on the transfer supporting body, and detecting a change of an amount of the reflected light. Likewise, in addition to the foregoing arrangement, the color misregistration correction method of the present invention may be such that the density detecting device detects the density average value by receiving reflected light including (i) light reflected within a predetermined region on a group image formed by superimposing the images of different color components and (ii) light reflected within the predetermined region on the transfer supporting body, and detecting a change of an amount of the reflected light.

According to this arrangement, because the density detecting device receives the reflected light including (i) the light reflected within the predetermined region (region through which the density detecting device can perform measurement) on the group image and (ii) the light reflected within the predetermined region on the transfer supporting body, and detects the change of the amount of the reflected light, the density can be detected in a wide region. Therefore, it is possible to use a less-expensive detector, without requiring an expensive detector having such a high resolution as to detect the positions of narrow lines or the like.

In addition to the foregoing arrangement, the image forming device of the present invention may be such that the density detecting device detects the density average value by receiving transmitted light including (i) light transmitted within a predetermined region through a group image formed by superimposing the images of different color components and (ii) light transmitted within the predetermined region through the transfer supporting body, and detecting a change of an amount of the transmitted light. Likewise, in addition to the foregoing arrangement, the color misregistration correction method of the present invention may be such that the density detecting device detects the density average value by receiving transmitted light including (i) light transmitted within a predetermined region through a group image formed by superimposing the images of different color components and (ii) light transmitted within the predetermined region through the transfer supporting body, and detecting a change of an amount of the transmitted light.

According to this arrangement, because the density detecting device receives the transmitted light including (i) the light transmitted within the predetermined region (region through which the density detecting device can perform measurement) through the group image and (ii) the light transmitted within the predetermined region through the transfer supporting body, and detects the change of the amount of the transmitted light, the density can be detected in a wide region. Therefore, it is possible to use a less-expensive detector, without requiring an expensive detector having such a high resolution as to detect the positions of narrow lines or the like.

In addition to the foregoing arrangement, the color misregistration correction method of the present invention may be such that, after the image forming step and the density detecting step, a rotational phase of a control-target image supporting body is shifted by a predetermined angle, and the image forming step and the density detecting step are performed again; the image forming step and the density detecting step are repeated until the rotational phase has been shifted by 360 degrees; and a difference between a maximum density value and a minimum density value of each density average value is calculated, and the correction value is calculated in accordance with such an angle of shift of the rotational phase that brings about the density average value at which the difference is smallest.

According to this arrangement, the rotational phase is shifted by 360 degrees, that is, by one rotation of the image supporting body, and, after each shift, an image is formed and the density average value is detected by using the density detecting device. In other words, the rotational phase of the image supporting body is shifted before forming an image, instead of changing the timing of image formation. With this arrangement, it is possible to detect, without fail, the condition in which the phases of unevenness in rotation (the unevenness in rotation is caused by rotational movement of the image supporting bodies and/or displacement of the cores of the image supporting bodies) are in phase.

In addition to the foregoing arrangement, the color misregistration correction method of the present invention may be such that, a difference between a maximum density value and a minimum density value of each density average value is calculated; operation of (i) shifting, by a predetermined angle, a rotational phase of a control-target image supporting body and (ii) performing the image forming step and the density detecting step is repeated until the difference becomes such a value that does not exceed a predetermined value; and the correction value is calculated in accordance with such an angle of shift of the rotational phase that brings about the density average value at which the difference does not exceed the predetermined value.

According to this arrangement, the condition in which the rotational phase of the reference image supporting body and the rotational phase of the control-target image supporting body are in phase is determined, and the rotational phase control is performed in accordance with the condition. That is, based on the density average value detected when the rotational phases of the image supporting bodies are in phase, an acceptable difference between the maximum density value and the minimum density value is determined and set in advance. Then, the difference between the maximum density value and the minimum density value detected during the rotational phase control is compared with the acceptable difference. As a result of comparison, if the difference between the maximum density value and the minimum density value detected during the rotational phase control is within the acceptable range, it means that the rotational phases of the image supporting bodies are in phase. Therefore, it is no longer necessary to shift the rotational phase, and to perform image formation and density detection. Instead, the rotational phase control is performed based on the current condition. With this arrangement, it is possible to save time and developer.

In addition to the foregoing arrangement, the image forming device of the present invention may further include a color overlap control device that controls an overlap of the different color components in each of the plurality of group images; and an adjustment device that adjusts whether to perform rotational phase control and color overlap control successively or independently. Likewise, in addition to the foregoing arrangement, the color misregistration correction method of the present invention may further include a color overlap control step, in which an overlap of the different color components in each of the plurality of group images is controlled, the rotational phase control step and the color overlap control step being performed successively or independently. Furthermore, in the color misregistration correction method of the present invention, the color overlap control step may be performed after the rotational phase control step is performed.

According to this arrangement, because the adjustment device that adjusts whether to perform rotational phase control and color overlap control successively or independently is further included, necessary control can be performed as need arises. Therefore, it is possible to reduce control time, and to perform stable control at high accuracy.

Moreover, by performing the rotational phase control before performing the color overlap control in the case where the rotational phase control and the color overlap control are performed as a set, stable image formation can be performed while the phases of unevenness in rotation of the image supporting bodies are in phase. As a result, the color overlap control, which is performed later, can be performed at high accuracy. If the color overlap control is performed before performing the rotational phase control, the rotational phase control can be performed while there is little disagreement between superimposed images.

In addition to the foregoing arrangement, the image forming device of the present invention may be such that the same image data is used both for performing the rotational phase control and for performing the color overlap control. Likewise, in addition to the foregoing arrangement, the color misregistration correction method of the present invention may be such that the same image data is used both for performing the rotational phase control step and for performing the color overlap control step.

According to this arrangement, because the same image data is used both for performing the rotational phase control and for performing the color overlap control, it is not necessary to store separate sets of image data (image data for the rotational phase control and image data for the color overlap control). Therefore, it is possible to reduce storage capacity of the section for storing the image data. In addition, it is possible to perform the rotational phase control and the color overlap control simultaneously.

In addition to the foregoing arrangement, the image forming device of the present invention may be such that the density detecting device is used for process control, the rotational phase control, and the color overlap control, the process control being performed so as to maintain excellent image quality. Likewise, in addition to the foregoing arrangement, the color misregistration correction method of the present invention may further include a process control step for maintaining excellent image quality, the density detecting device being used in the rotational phase control step, the color overlap control step, and the process control step.

According to this arrangement, it is possible to perform the process control, the rotational phase control, and the color overlap control by the single density detecting device. Therefore, it is not necessary to provide an independent density detecting device for each control. Moreover, because a density detecting device for measuring the density of a relatively wide region including the group image and the transfer supporting body can be used, it is not necessary to use a high-resolution density detecting device. Therefore, it is possible to save cost for the density detecting device, hence cost for the image forming device.

In addition to the foregoing arrangement, the image forming device of the present invention and the color misregistration correction method of the present invention may be such that, in the sub-scanning direction, the images of different color components have a length not shorter than one-half of a circumference of the plurality of image supporting bodies.

The size of the color misregistration, which is caused by the unevenness in rotation of the image supporting bodies, has a period equivalent to one-half of the rotation of the image supporting bodies. Therefore, it is necessary that, in the sub-scanning direction, the image formed to calculate the correction value have a length not shorter than one-half of the circumference of the plurality of image supporting bodies. In order to enhance reliability, the image may be formed so as to have a length of one rotation.

If the image is formed so as to have a length not shorter than one-half of the rotation of the plurality of image supporting bodies, the image is formed within a narrower range. Therefore, this arrangement not only allows for correcting the color misregistration in the image forming device, but also allows for saving developer, because the amount of developer used for forming the image depends on the range of the image.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming device, comprising:

a plurality of image supporting bodies on which images of different color components are formed in accordance with image data;

a transfer supporting body that moves in a sub-scanning direction so that the images of different color components are sequentially superimposed on the transfer supporting body;

a density detecting device that detects a density average value with respect to each of a plurality of group images formed at different positions by superimposing the images of different color components;

a correction value calculating device that calculates, in accordance with the density average value and a rotational phase, a correction value to be used for synchronizing rotational phases of the plurality of image supporting bodies; and a rotational phase control device that controls the rotational phases of the plurality of image supporting bodies in accordance with the correction value.

2. The image forming device as set forth in claim 1, wherein:

the images of different color components are (i) pattern images in which a predetermined number of line images extending in a main scanning direction are provided at a predetermined interval, and (ii) identical patterns formed in accordance with the same image data.

3. The image forming device as set forth in claim 1, wherein:

each of the plurality of group images is formed by transferring one image from a reference image supporting body to the transfer supporting body, and transferring another image from a control-target image supporting body onto said one image by superimposition.

4. The image forming device as set forth in claim 1, wherein:

the density detecting device detects the density average value by receiving reflected light including (i) light reflected within a predetermined region on a group image formed by superimposing the images of different color components and (ii) light reflected within the predetermined region on the transfer supporting body, and detecting a change of an amount of the reflected light.

5. The image forming device as set forth in claim 1, wherein:

the density detecting device detects the density average value by receiving transmitted light including (i) light transmitted within a predetermined region through a group image formed by superimposing the images of different color components and (ii) light transmitted within the predetermined region through the transfer supporting body, and detecting a change of an amount of the transmitted light.

6. An image forming device as set forth in claim 1, further comprising:

a color overlap control device that controls an overlap of the different color components in each of the plurality of group images; and an adjustment device that adjusts whether to perform rotational phase control and color overlap control successively or independently.

7. The image forming device as set forth in claim 6, wherein:

the same image data is used both for performing the rotational phase control and for performing the color overlap control.

8. The image forming device as set forth in claim 6, wherein:

the density detecting device is used for process control, the rotational phase control, and the color overlap control, the process control being performed so as to maintain excellent image quality.

9. The image forming device as set forth in claim 1, wherein:

in the sub-scanning direction, the images of different color components have a length not shorter than one-half of a circumference of the plurality of image supporting bodies.

10. The image forming device as set forth in claim 1, wherein the correction value is calculated to reduce misalignment of the image of different color components caused by unevenness in rotation of the plurality of image supporting bodies.

11. The image forming device as set forth in claim 10, wherein the unevenness in rotation is caused by a non-constant velocity of one or more of the plurality of image supporting bodies.

12. The image forming device as set forth in claim 10, wherein the unevenness in rotation is caused by a non-constant surface velocity of one or more of the plurality of image supporting bodies.

13. A color misalignment correction method for an image forming device, comprising:

an image forming step, in which images of different color components are formed on a plurality of image supporting bodies in accordance with image data;

an image superimposing step, in which the images of different color components are sequentially superimposed on a transfer supporting body, which is moving in a sub-scanning direction;

a density detecting step, in which a density average value is detected by using a density detecting device with respect to each of a plurality of group images formed at different positions by superimposing the images of different color components;

a correction value calculating step, in which a correction value to be used for synchronizing rotational phases of the plurality of image supporting bodies is calculated in accordance with the density average value and a rotational phase; and a rotational phase control step, in which the rotational phases of the plurality of image supporting bodies are controlled in accordance with the correction value.

14. The color misalignment correction method as set forth in claim 13, wherein:

the images of different color components are (i) pattern images in which a predetermined number of line images extending in a main scanning direction are provided at a predetermined interval, and (ii) identical patterns formed in accordance with the same image data.

15. The color misalignment correction method as set forth in claim 13, wherein:

the density detecting device detects the density average value by receiving reflected light including (i) light reflected within a predetermined region on a group image formed by superimposing the images of different color components and (ii) light reflected within the predetermined region on the transfer supporting body, and detecting a change of an amount of the reflected light.

16. The color misalignment correction method as set forth in claim 13, wherein:

the density detecting device detects the density average value by receiving transmitted light including (i) light transmitted within a predetermined region through a group image formed by superimposing the images of different color components and (ii) light transmitted within the predetermined region through the transfer supporting body, and detecting a change of an amount of the transmitted light.

17. The color misalignment correction method as set forth in claim 13, wherein:

after the image forming step and the density detecting step, a rotational phase of a control-target image supporting body is shifted by a predetermined angle, and the image forming step and the density detecting step are performed again;

the image forming step and the density detecting step are repeated until the rotational phase has been shifted by 360 degrees; and for each performance of the density detecting step, a difference between a maximum detected density value and a minimum detected density value of the detected density average values is calculated, and the correction value is calculated in accordance with an angle of shift of the rotational phase corresponding to the performance of the density detecting step for which the smallest difference is calculated.

18. The color misalignment correction method as set forth in claim 13, wherein:

a difference between a maximum detected density value and a minimum detected density value of the detected density average values is calculated;

operation of (i) shifting, by a predetermined angle, a rotational phase of a control-target image supporting body and (ii) performing the image forming step and the density detecting step is repeated until the difference becomes such a value that does not exceed a predetermined value; and the correction value is calculated in accordance with such an angle of shift of the rotational phase that brings about the density average value at which the difference does not exceed the predetermined value.

19. A color misalignment correction method as set forth in claim 13, further comprising:

a color overlap control step, in which an overlap of the different color components in each of the plurality of group images is controlled, the rotational phase control step and the color overlap control step being performed successively or independently.

20. The color misalignment correction method as set forth in claim 19, wherein:

the color overlap control step is performed after the rotational phase control step is performed.

21. The color misalignment correction method as set forth in claim 19, wherein:

the same image data is used both for performing the rotational phase control step and for performing the color overlap control step.

22. The color misalignment correction method as set forth in claim 19, further comprising:

a process control step for maintaining excellent image quality, the density detecting device being used in the rotational phase control step, the color overlap control step, and the process control step.

23. The color misalignment correction method as set forth in claim 13, wherein:

in the sub-scanning direction, the images of different color components have a length not shorter than one-half of a circumference of the plurality of image supporting bodies.

24. The color misalignment correction method as set forth in claim 13, wherein:

after the image forming step and the density detecting step, a rotational phase of a control-target image supporting body is shifted by a predetermined angle, and the image forming step and the density detecting step are performed again;

the image forming step and the density detecting step are repeated until the rotational phase has been shifted by 360 degrees; and a difference between a maximum detected density value and a minimum detected density value of the detected density average values is calculated with respect to each angle of shift, and the correction value is calculated in accordance with an angle of shift at which the difference is smallest.

25. The color misalignment correction method as set forth in claim 13, wherein:

a difference between a maximum detected density value and a minimum detected density value of the detected density average values is calculated;

operation of (i) shifting, by a predetermined angle, a rotational phase of a control-target image supporting body and (ii) performing the image forming step and the density detecting step is repeated until the difference becomes such a value that does not exceed a predetermined value; and the correction value is calculated in accordance with an angle of shift at which the difference does not exceed the predetermined value.

26. The color misalignment correction method as set forth in claim 13, wherein the correction value is calculated to reduce misalignment of the images of different color components caused by unevenness in rotation of the plurality of image supporting bodies.

* * * * *